US011231035B2

(12) United States Patent
Iwatake et al.

(10) Patent No.: US 11,231,035 B2
(45) Date of Patent: Jan. 25, 2022

(54) SCROLL COMPRESSOR

(71) Applicant: Mitsubishi Electric Corporation, Tokyo (JP)

(72) Inventors: Wataru Iwatake, Tokyo (JP); Shin Sekiya, Tokyo (JP); Masayuki Kakuda, Tokyo (JP); Raito Kawamura, Tokyo (JP); Kei Sasaki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/980,426

(22) PCT Filed: Apr. 23, 2018

(86) PCT No.: PCT/JP2018/016418
§ 371 (c)(1),
(2) Date: Sep. 14, 2020

(87) PCT Pub. No.: WO2019/207617
PCT Pub. Date: Oct. 31, 2019

(65) Prior Publication Data
US 2021/0003131 A1 Jan. 7, 2021

(51) Int. Cl.
*F04C 18/02* (2006.01)
*F04C 29/02* (2006.01)

(52) U.S. Cl.
CPC ..... *F04C 18/0215* (2013.01); *F04C 29/02* (2013.01)

(58) Field of Classification Search
CPC ..... F04C 18/0215; F04C 18/0253; F04C 23/008; F04C 29/02
See application file for complete search history.

(56) References Cited

U.S. PATENT DOCUMENTS 8,313,318 B2 * 11/2012 Stover ..... F04C 28/265 418/55.5
9,897,088 B2 * 2/2018 Su ..... F04C 14/26
(Continued)

FOREIGN PATENT DOCUMENTS

JP 63-106388 A 5/1988
JP 05-149277 A 6/1993
(Continued)

OTHER PUBLICATIONS

International Search Report and Written Opinion dated Jul. 17, 2018 for PCT/JP2018/016418 filed on Apr. 23, 2018, 10 pages including English Translation of the International Search Report.

*Primary Examiner* — Audrey B. Walter
*Assistant Examiner* — Dapinder Singh
(74) *Attorney, Agent, or Firm* — Xsensus LLP

(57) ABSTRACT

A scroll compressor in which refrigerant gas is sucked into a hermetic container and is then compressed in a compression chamber. The scroll compressor includes an orbiting scroll including a second end plate having a second surface. The second end plate has an annular groove having an opening that opens into the second surface facing a frame and serving as a back-pressure chamber with the opening being closed by the frame, a gas communication path through which the groove communicates with the compression chamber in which the refrigerant gas is being compressed, and a first oil supply passage having a first opening that opens into at least one of a region inside the groove and a region outside the groove in the second surface and through which the refrigerating machine oil is supplied to a gap between the second surface and the frame.

5 Claims, 14 Drawing Sheets

(56) References Cited

U.S. PATENT DOCUMENTS

| | | | | |
|---|---|---|---|---|
| 10,393,117 | B2 * | 8/2019 | Ogata | F04C 23/02 |
| 2014/0086777 | A1 * | 3/2014 | Park | F04C 18/0215 418/55.5 |
| 2016/0047378 | A1 * | 2/2016 | Choi | F04C 29/12 418/55.1 |

FOREIGN PATENT DOCUMENTS

| | | | |
|---|---|---|---|
| JP | 09-158857 | A | 6/1997 |
| JP | 2011-231653 | A | 11/2011 |

* cited by examiner (C) θ =180deg (D) θ =270deg

SCROLL COMPRESSOR

CROSS-REFERENCE TO RELATED APPLICATION

The present application is based on PCT filing PCT/JP2018/016418, filed Apr. 23, 2018, the entire contents of which are incorporated herein by reference.

TECHNICAL FIELD

The present disclosure relates to a scroll compressor designed to reduce the load on an orbiting scroll.

BACKGROUND ART

A typical air-conditioning apparatus, such as a multi-air-conditioning apparatus for a building, includes a refrigerant circuit in which, for example, a compressor, an outdoor heat exchanger, and an indoor heat exchanger are connected by refrigerant pipes. The compressor and the outdoor heat exchanger are contained in an outdoor unit that is a heat source unit. The outdoor unit is disposed outdoors, for example. The indoor heat exchanger is contained in an indoor unit disposed in an indoor space that is an air-conditioned space. The air-conditioning apparatus causes refrigerant to be circulated through the refrigerant circuit, and uses heat transfer and heat removal by the refrigerant to heat or cool air in the air-conditioned space, thereby heating or cooling the air-conditioned space.

Some of such air-conditioning apparatuses include a scroll compressor. The scroll compressor includes a compression mechanism including a fixed scroll and an orbiting scroll. In the compression mechanism, a wrap of the fixed scroll and a wrap of the orbiting scroll are combined together to define a compression chamber between the wraps. As the orbiting scroll orbits relative to the fixed scroll, the compression chamber decreases in volume such that refrigerant gas in the compression chamber is compressed. During such compression of the refrigerant gas, the orbiting scroll experiences a load from the refrigerant gas in the compression chamber. For this reason, the scroll compressor includes a frame that faces an end plate of the orbiting scroll and supports the load on the orbiting scroll during compression of the refrigerant gas.

If the air-conditioning apparatus is operated under low outdoor-air temperature conditions, such as in a cold region, the difference between a low-pressure side refrigerant pressure and a high-pressure side refrigerant pressure in the refrigerant circuit will increase. Therefore, if the air-conditioning apparatus is operated under low outdoor-air temperature conditions, the load on the orbiting scroll from the refrigerant gas in the compression chamber during compression of the refrigerant gas will increase. An increase in load on the orbiting scroll may cause, for example, an increase in sliding loss between the end plate of the orbiting scroll and the frame, wear of the end plate of the orbiting scroll and the frame, and seizing of the end plate of the orbiting scroll to the frame. Related-art scroll compressors include a scroll compressor designed to reduce the load on the orbiting scroll from the refrigerant gas in the compression chamber during compression (refer to Patent Literature 1).

Specifically, the scroll compressor disclosed in Patent Literature 1 is a low-pressure shell scroll compressor in which Low-pressure refrigerant gas is sucked into a hermetic container and is then compressed in a compression chamber. The scroll compressor disclosed in Patent Literature 1 includes a frame having a surface that faces an orbiting scroll and the surface of the frame has a groove, serving as a back-pressure chamber. An end plate of the orbiting scroll closes an opening of the groove, so that the groove functions as a back-pressure chamber. The refrigerant gas in compression is introduced into the back-pressure chamber. Specifically, in the scroll compressor disclosed in Patent Literature 1, the load from the refrigerant gas, which is being compressed, introduced into the back-pressure chamber acts in a direction opposite to a direction in which the load from the refrigerant gas in the compression chamber acts on the orbiting scroll. This achieves a reduction in load on the orbiting scroll from the refrigerant gas in the compression chamber in the scroll compressor disclosed in Patent Literature 1.

In the scroll compressor disclosed in Patent Literature 1, the end plate of the orbiting scroll has an oil supply passage to which refrigerating machine oil is supplied. The oil supply passage has openings in a surface of the end plate that faces the frame. The refrigerating machine oil supplied to the oil supply passage is supplied to a gap between the end plate of the orbiting scroll and the frame through the openings. The refrigerating machine oil, supplied to the gap between the end plate of the orbiting scroll and the frame, allows smooth movement of the end plate of the orbiting scroll relative to the frame, and also functions to seal the gap between the end plate of the orbiting scroll and the frame to reduce or eliminate refrigerant leakage from the back-pressure chamber.

CITATION LIST

Patent Literature

Patent Literature 1: Japanese Unexamined Patent Application Publication No. 2011-231653

SUMMARY OF INVENTION

Technical Problem

In the scroll compressor disclosed in Patent Literature 1, the groove, serving as the back-pressure chamber, is located in the frame, and the oil supply passage is located in the end plate of the orbiting scroll. In other words, the positions of the openings of the oil supply passage change relative to the groove, serving as the back-pressure chamber, while the orbiting scroll is orbiting during a refrigerant gas compression operation. Furthermore, to supply the refrigerating machine oil to the gap between the end plate of the orbiting scroll and the frame, the openings of the oil supply passage need to be arranged so as not to communicate with the groove, serving as the back-pressure chamber. For this reason, in the scroll compressor disclosed in Patent Literature 1, the openings of the oil supply passage need to be arranged apart from the groove, serving as the back-pressure chamber. Therefore, in the scroll compressor disclosed in Patent Literature 1, the refrigerating machine oil fails to be sufficiently supplied to an area in proximity to edges of the groove, serving as the back-pressure chamber, so that refrigerant leakage from the back-pressure chamber fails to be sufficiently reduced or eliminated. This may lead to unstable behavior of the orbiting scroll, resulting in lower reliability of the scroll compressor disclosed in Patent Literature 1. In addition, this may lead to an increase in sliding loss between the end plate of the orbiting scroll and the frame, resulting in lower performance of the scroll compressor disclosed in Patent Literature 1.

The scroll compressor of present disclosure is intended to overcome the above-described problem, and aims to provide a scroll compressor in which refrigerant leakage from a back-pressure chamber is less likely to occur than in the related art.

Solution to Problem

A scroll compressor according to an embodiment of the present disclosure includes a fixed scroll including a first end plate and a first wrap located on the first end plate, an orbiting scroll including a second end plate and a second wrap located on a first surface of the second end plate that faces the fixed scroll, the orbiting scroll being disposed to define a compression chamber to compress refrigerant between the first wrap and the second wrap and orbiting relative to the fixed scroll, a frame facing a second surface opposite the first surface in the orbiting scroll and supporting a load on the orbiting scroll during compression of refrigerant gas, and a hermetic container containing the fixed scroll, the orbiting scroll, and the frame and including an oil sump in which refrigerating machine oil is held. The scroll compressor is configured to suck the refrigerant gas into the hermetic container and then compress the refrigerant gas in the compression chamber. The second end plate has an annular groove having an opening that opens into the second surface and serving as a back-pressure chamber with the opening being closed by the frame, a gas communication path through which the groove communicates with the compression chamber in which the refrigerant gas is being compressed, and a first oil supply passage having a first opening that opens into at least one of a region inside the groove and a region outside the groove in the second surface and through which the refrigerating machine oil is supplied to a gap between the second surface and the frame.

Advantageous Effects of Invention

In the scroll compressor according to the embodiment of the present disclosure, both the annular groove, serving as the back-pressure chamber, and the first oil supply passage are located in the second end plate of the orbiting scroll. In other words, the distance between the annular groove, serving as the back-pressure chamber, and the first opening of the first oil supply passage is constant at all times in the scroll compressor according to the embodiment of the present disclosure. Such a configuration of the scroll compressor according to the embodiment of the present disclosure enables the first opening of the first oil supply passage to be closer to the annular groove, serving as the back-pressure chamber, than in the related art. Therefore, in the scroll compressor according to the embodiment of the present disclosure, an area in proximity to edges of the annular groove, serving as the back-pressure chamber, can be supplied with a more sufficient amount of refrigerating machine oil than in the related art, so that refrigerant leakage from the back-pressure chamber can be reduced or eliminated as compared with the related art.

DESCRIPTION OF EMBODIMENTS

An example of a scroll compressor according to the present disclosure will be described in each embodiment with reference to the drawings. Note that components designated by the same reference signs in the following figures are the same components or equivalents. Furthermore, note that the components described in the following embodiments are intended to be illustrative only. The components of the scroll compressor according to the present disclosure are not limited to those described in the following embodiments. Additionally, a combination of the components is not intended to be limited only to that in each embodiment. The components described in different embodiments may be combined.

Embodiment 1

Figure 1:
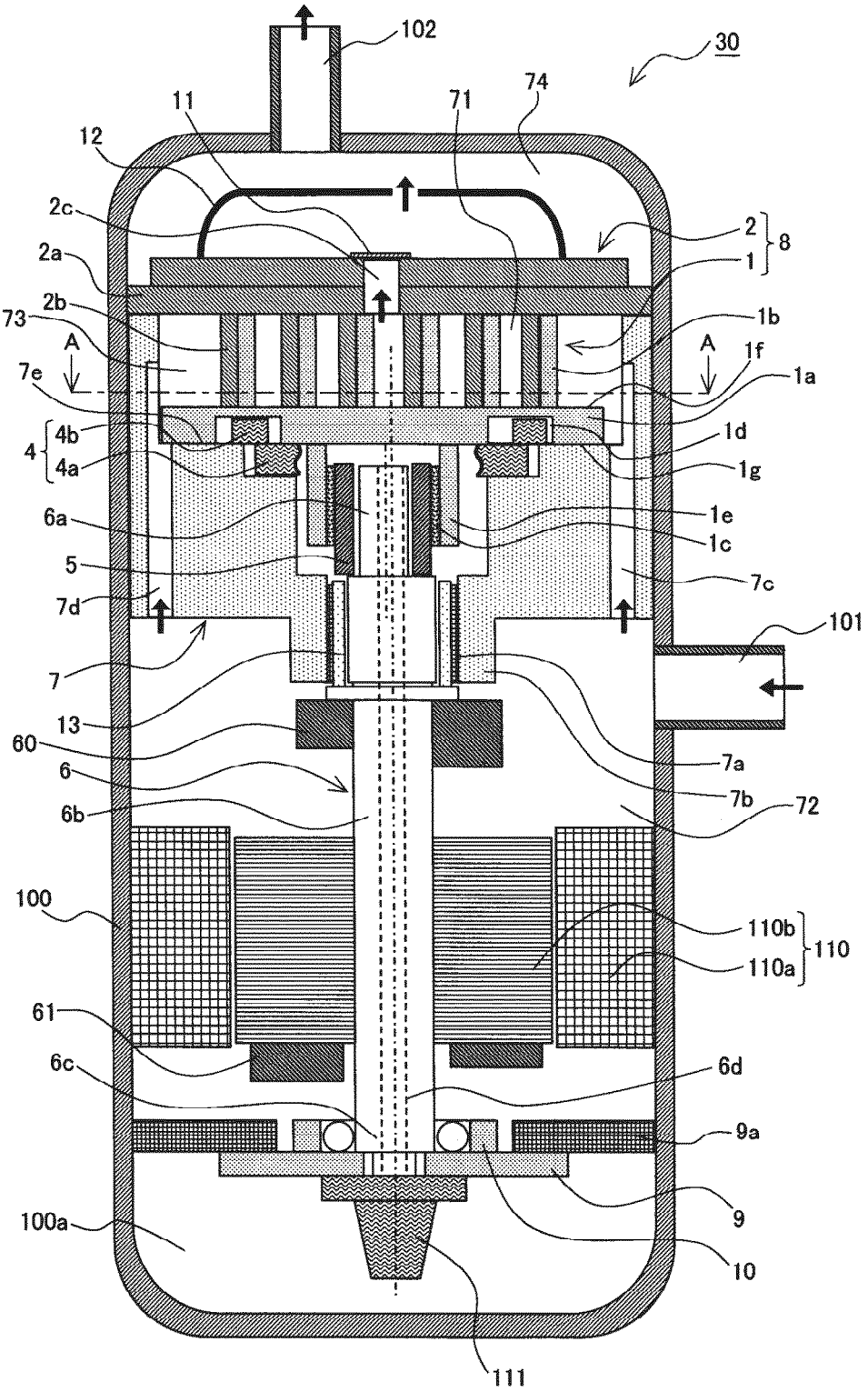
FIG. 1 is a schematic longitudinal sectional view illustrating an entire configuration of a scroll compressor according to Embodiment 1 of the present disclosure.
Figure 2:
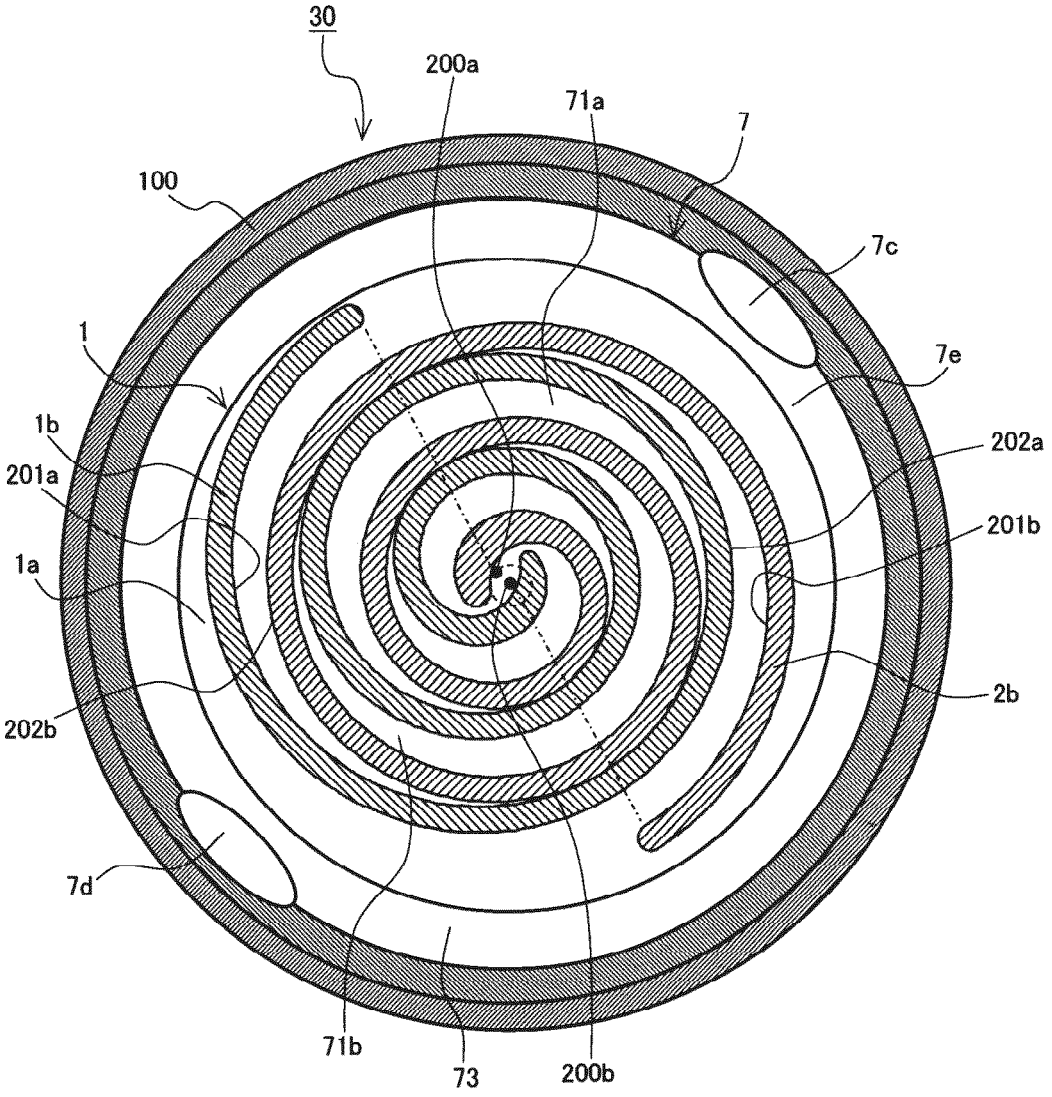
FIG. 2 is a cross-sectional view taken along line A-A in FIG. 1.

FIG. 1 is a schematic longitudinal sectional view illustrating an entire configuration of a scroll compressor according to Embodiment 1 of the present disclosure. FIG. 2 is a cross-sectional view taken along line A-A in FIG. 1.

A scroll compressor 30 according to Embodiment 1 includes a compression mechanism 8 including an orbiting scroll 1 and a fixed scroll 2, a motor 110, and a rotating shaft 6 transmitting a driving force of the motor 110 to the compression mechanism 8. The scroll compressor 30 further includes a hermetic container 100 containing the compression mechanism 8, the motor 110, and the rotating shaft 6, and constituting an outer casing of the scroll compressor 30. The scroll compressor 30 is a low-pressure shell scroll compressor in which Low-pressure refrigerant gas is sucked into the hermetic container 100 and is then compressed in the compression mechanism 8.

The hermetic container 100 further contains a frame 7 and a sub-frame 9 such that the frame 7 and the sub-frame 9 are arranged with the motor 110 therebetween in a direction along the axis of the rotating shaft 6. The frame 7 is disposed above the motor 110, and is located between the motor 110 and the compression mechanism 8. The sub-frame 9 is located below the motor 110. The frame 7 is fixed to an inner circumferential surface of the hermetic container 100 by, for example, shrink fitting or welding. The sub-frame 9 is fixed to a sub-frame holder 9*a*. The sub-frame holder 9*a* is fixed to the inner circumferential surface of the hermetic container 100 by, for example, shrink fitting or welding.

The rotating shaft 6 transmits a driving force of the motor 110 to the orbiting scroll 1 in the hermetic container 100. The orbiting scroll 1 is eccentrically coupled to the rotating shaft 6 and is combined with the frame 7 with an Oldham ring 4 therebetween. In other words, the Oldham ring 4 is disposed between the orbiting scroll 1 and the frame 7. Specifically, the Oldham ring 4 is disposed between the frame 7 and an end plate 1*a*, which will be described later, of the orbiting scroll 1. The Oldham ring 4 incudes a ring portion 4*a* and a plurality of keys 4*b*. The end plate 1*a* of the orbiting scroll 1 has a plurality of key grooves 1*d*. The keys 4*b* of the Oldham ring 4 are slidably fitted in the key grooves 1*d* arranged in the end plate 1*a* of the orbiting scroll 1. The Oldham ring 4 further includes a plurality of keys (not illustrated). These keys are slidably fitted in key grooves (not illustrated) in the frame 7. When the orbiting scroll 1 is nearly rotated by the driving force of the motor 110, the Oldham ring 4 restricts rotation of the orbiting scroll 1. As a result, when the orbiting scroll 1 is nearly rotated by the driving force of the motor 110, the orbiting scroll 1 revolves without rotating. In other words, the orbiting scroll 1 orbits.

A pump element 111 including a positive displacement pump is attached to lower part of the sub-frame 9 such that an upper end face of the pump element axially supports the rotating shaft 6. The pump element 111 supplies refrigerating machine oil, which is held in an oil sump 100*a* located in bottom part of the hermetic container 100, to sliding parts of the compression mechanism 8, for example.

The hermetic container 100 includes a suction pipe 101 through which the refrigerant gas is sucked into the container and a discharge pipe 102 through which the refrigerant gas is discharged out of the container. The refrigerant is sucked into the hermetic container 100 through the inlet pipe 101.

The compression mechanism 8 has the function of compressing the refrigerant gas sucked into the hermetic container 100 through the suction pipe 101 and forcing the compressed refrigerant gas to flow into a high-pressure space located in upper part of the hermetic container 100. The compression mechanism 8 includes the orbiting scroll 1 and the fixed scroll 2.

The fixed scroll 2 includes an end plate 2*a* that is a first end plate and a wrap 2*b* that is a first wrap. The wrap 2*b* is located on one surface of the end plate 2*a*. The fixed scroll 2 is fixed to the frame 7.

The orbiting scroll 1 includes the end plate 1*a* that is a second end plate and a wrap 1*b* that is a second wrap. The end plate 1*a* has a first surface 1*f* facing the fixed scroll 2 and a second surface 1*g* opposite the first surface 1*f*. The wrap 1*b* is located on the first surface 1*f* of the end plate 1*a*. The orbiting scroll 1 further includes a boss 1*e* located on the second surface 1*g* of the end plate 1*a*. The boss 1*e* supports an eccentric shaft portion 6*a*, which will be described later, of the rotating shaft 6 such that the eccentric shaft portion 6*a* is rotatable.

The orbiting scroll 1 and the fixed scroll 2 are combined and arranged in the hermetic container 100 such that the wrap 1*b* and the wrap 2*b* are opposite in phase to each other to form a symmetric spiral pattern.

Figure 3:
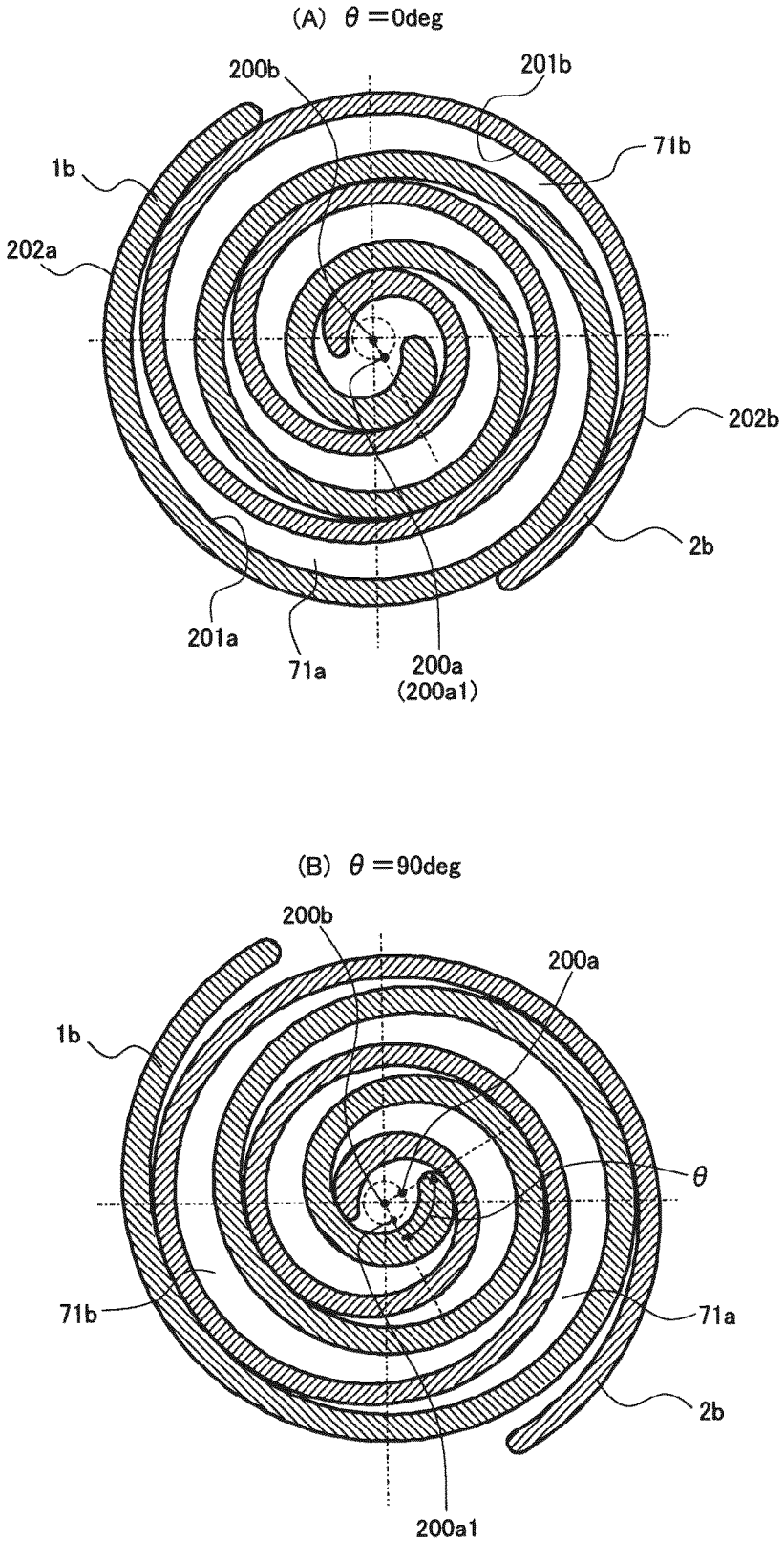
FIG. 3 includes diagrams explaining a refrigerant gas compression operation of the scroll compressor according to Embodiment 1 of the present disclosure.
Figure 4:
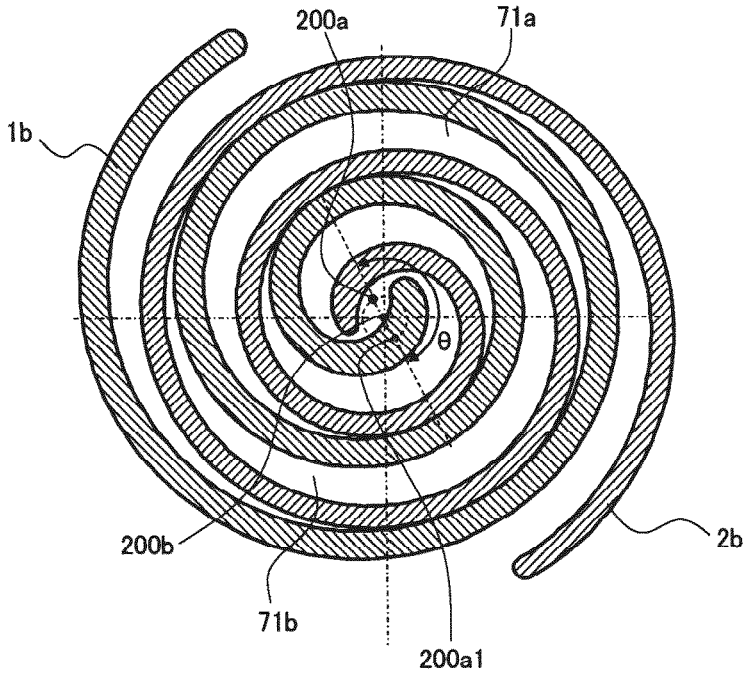
FIG. 4 includes diagrams explaining the refrigerant gas compression operation of the scroll compressor according to Embodiment 1 of the present disclosure.
Figure 4:
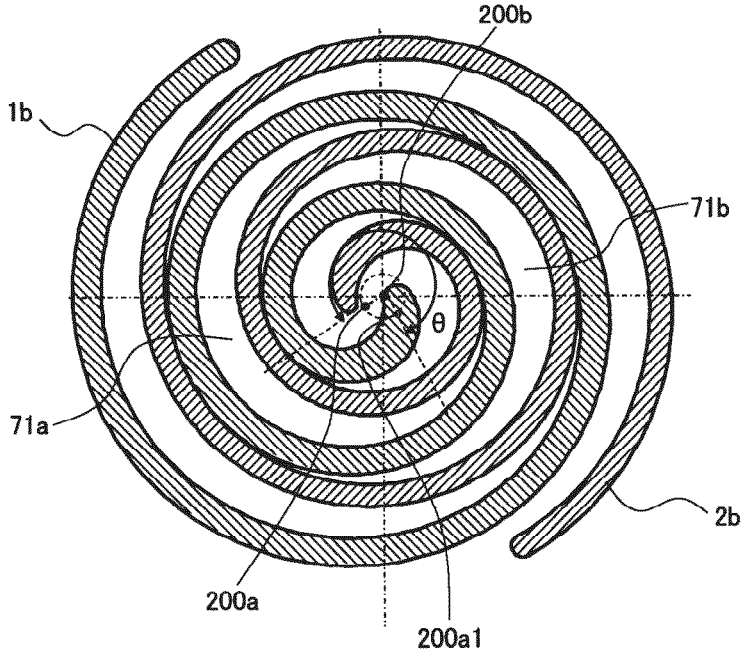

The center of a base circle for an involute curve drawn by the wrap 1*b* will be referred to as a base circle center 200*a*. In addition, the center of a base circle for an involute curve drawn by the wrap 2*b* will be referred to as a base circle center 200*b*. The base circle center 200*a* revolves at a predetermined radius around the base circle center 200*b*, so that the wrap 1*b* orbits around the wrap 2*b* as illustrated in FIGS. 3 and 4, which will be described later. In other words, the orbiting scroll 1 orbits at a predetermined radius with respect to the fixed scroll 2. Hereinafter, the predetermined radius will be referred to as an orbit radius. The orbit radius is substantially the distance between the axis of a main shaft portion 6*b*, which will be described later, of the rotating shaft 6 and the axis of the eccentric shaft portion 6*a*, which will be described later. The motion of the orbiting scroll 1 during driving of the scroll compressor 30 will be described in detail later.

When the wrap 1*b* is viewed from the base circle center to its terminal, an inward-facing surface 201*a* of the wrap 1*b* and an outward-facing surface 202*b* of the wrap 2*b* have a plurality of contact points therebetween. In other words, a space between the inward-facing surface 201*a* of the wrap 1*b* and the outward-facing surface 202*b* of the wrap 2*b* is divided into a plurality of chambers by the contact points. Furthermore, when the wrap 2*b* is viewed from the base circle center to its terminal, an inward-facing surface 201*b* of the wrap 2*b* and an outward-facing surface 202*a* of the wrap 1*b* have a plurality of contact points therebetween. In other words, a space between the inward-facing surface 201*b* of the wrap 2*b* and the outward-facing surface 202*a* of the wrap 1*b* is divided into a plurality of chambers by the contact points. The wrap 1*b* and the wrap 2*b* have a symmetrical spiral shape. As illustrated in FIG. 2, the wrap 1*b* and the wrap 2*b* define therebetween a pair of chambers, or a plurality of chambers, located adjacent to the outsides of the wraps.

Of the above-described chambers, a space surrounded by the inward-facing surface 201*a* of the wrap 1*b*, the outward-facing surface 202*b* of the wrap 2*b*, the end plate 1*a*, and the end plate 2*a* is defined as a compression chamber 71*a*. In addition, a space surrounded by the outward-facing surface 202*a* of the wrap 1*b*, the inward-facing surface 201*b* of the wrap 2*b*, the end plate 1*a*, and the end plate 2*a* is defined as a compression chamber 71*b*. If the compression chamber 71*a* and the compression chamber 71*b* are expressed without being distinguished from each other, they will be described as compression chambers 71.

As described above, the wrap 2*b* and the wrap 1*b* are in contact with each other at some points. Each of the compression chamber 71*a* and the compression chamber 71*b* is the space formed between two contact points. As the wrap 1*b* revolves as will be described later, the positions of contact between the wrap 2*b* and the wrap 1*b* are shifted. The revolution causes a change in volume of each of the compression chamber 71*a* and the compression chamber 71*b*. Accordingly, a pressure in each of the compression chamber 71*a* and the compression chamber 71*b* changes as the rotating shaft 6 rotates. Thus, the refrigerant gas is compressed in the compression chamber 71*a* and the compression chamber 71*b*.

As described above, the wrap 2*b* of the fixed scroll 2 is combined with the wrap 1*b* of the orbiting scroll 1 to define the compression chamber 71*a* and the compression chamber 71*b* for refrigerant compression between the wrap 2*b* and the wrap 1*b*.

The end plate 2*a* of the fixed scroll 2 has a discharge port 2*c* of the fixed scroll 2. A discharge valve 11 is disposed at the discharge port 2*c*. A discharge muffler 12 is attached to cover the discharge port 2*c*.

The frame 7 faces the second surface 1*g* of the end plate 1*a* of the orbiting scroll 1. The frame 7 has a thrust face 7*e* facing the second surface 1*g* of the end plate 1*a* of the orbiting scroll 1. The thrust face 7*e* is a face to slidably support the orbiting scroll 1 and to support the load on the orbiting scroll 1 during compression of the refrigerant gas. The frame 7 further has an opening 7*c* and an opening 7*d*, through which the refrigerant gas sucked through the suction pipe 101 is introduced into the compression mechanism 8, such that the openings extend through the frame.

The motor 110, which supplies a driving force to the rotating shaft 6, includes a stator 110*a* and a rotor 110*b*. To receive power from the outside, the stator 110*a* is connected to a glass terminal (not illustrated) located between the frame 7 and the stator 110*a* by a lead wire (not illustrated). The rotor 110*b* is joined to the main shaft portion 6*b*, which will be described later, of the rotating shaft 6 by shrink fitting, for example. To balance the whole of a rotation system in the scroll compressor 30, a first balance weight 60 is fixed to the rotating shaft 6 and a second balance weight 61 is fixed to the rotor 110*b*.

The rotating shaft 6 includes the eccentric shaft portion 6*a* that is upper part of the rotating shaft 6, the main shaft portion 6*b*, and a sub-shaft portion 6*c* that is lower part of the rotating shaft 6.

The main shaft portion 6*b* is rotatably supported by a main bearing 7*a* disposed on an inner circumferential surface of a boss 7*b* included in the frame 7. In Embodiment 1, a sleeve 13 is attached to an outer circumferential surface of the main shaft portion 6*b*. The sleeve 13 is rotatably supported by the main bearing 7*a*. The refrigerating machine oil is supplied to a gap between the sleeve 13 and the main bearing 7*a*. Accordingly, the sleeve 13 slides relative to the main bearing 7*a* with an oil film formed by the refrigerating machine oil therebetween. The main bearing 7*a* is made of a bearing material used for a sliding bearing, such as an alloy of copper and lead. The main bearing 7*a* is fixed to the inside of the boss 7*b* by, for example, press-fitting. As described above, the main shaft portion 6*b* is joined to the rotor 110*b* by, for example, shrink fitting.

A sub-bearing 10, which is a ball bearing, is located on an upper surface of the sub-frame 9. The sub-bearing 10 is located below the motor 110, and supports the sub-shaft portion 6*c* such that the sub-shaft portion 6*c* is rotatable radially. The sub-bearing 10 may be of any type other than the ball bearing. The main shaft portion 6*b* is axially aligned with the sub-shaft portion 6*c*.

The axis of the eccentric shaft portion 6*a* is eccentric with respect to the axis of the main shaft portion 6*b*. The eccentric shaft portion 6*a* is rotatably supported by the boss 1*e* of the orbiting scroll 1. In Embodiment 1, a slider 5 is located adjacent to an outer circumferential surface of the eccentric shaft portion 6*a* such that the slider 5 is slidable relative to the eccentric shaft portion 6*a*. In Embodiment 1, an orbiting bearing 1*c* is located on an inner circumferential surface of the boss 1*e*. The orbiting bearing 1*c* is made of a bearing material for a sliding bearing, such as an alloy of copper and lead. The slider 5 is rotatably fitted on an inner circumferential surface of the orbiting bearing 1*c*. Specifically, in Embodiment 1, the eccentric shaft portion 6*a* is rotatably supported by the boss 1*e* such that the slider 5 and the orbiting bearing 1*c* are interposed between the eccentric shaft portion 6*a* and the boss 1*e*.

As the main shaft portion 6*b* rotates, the eccentric shaft portion 6*a* eccentric with respect to the main shaft portion 6*b* rotates relative to the main shaft portion 6*b* at a radius corresponding to the distance between the axis of the main shaft portion 6*b* and the axis of the eccentric shaft portion 6*a*. Thus, the orbiting scroll 1 coupled to the eccentric shaft portion 6*a* with the slider 5 and the orbiting bearing 1*c* therebetween nearly rotates relative to the main shaft portion 6*b* at the above-described orbit radius. In other words, the orbiting scroll 1 nearly rotates at the above-described orbit radius with respect to the fixed scroll 2, which is stationary. At this time, as described above, the Oldham ring 4 restricts rotation of the orbiting scroll 1. Accordingly, the orbiting scroll 1 orbits at the above-described orbit radius with respect to the fixed scroll 2.

In the scroll compressor 30 according to Embodiment 1, the eccentric shaft portion 6*a* is coupled to the boss 1*e* of the orbiting scroll 1 such that the slider 5 is interposed between the eccentric shaft portion 6*a* and the boss 1*e*. Thus, the above-described orbit radius is the sum of the distance between the axis of the main shaft portion 6*b* and the axis of the eccentric shaft portion 6*a* and a distance by which the slider 5 is movable relative to the eccentric shaft portion 6*a*. In other words, the above-described orbit radius is greater than or equal to the distance between the axis of the main shaft portion 6*b* and the axis of the eccentric shaft portion 6*a*.

A space inside the hermetic container 100 is defined as follows. A space located between the frame 7 and the rotor 110*b* is defined as a first space 72. A space located between the frame 7 and the end plate 2*a* of the fixed scroll 2 is defined as a second space 73. A space located between the end plate 2*a* and the discharge pipe 102 is defined as a third space 74.

A refrigerant gas compression operation in the compression mechanism 8 will now be described with reference to FIGS. 3 and 4.

FIGS. 3 and 4 are diagrams explaining the refrigerant gas compression operation of the scroll compressor according to Embodiment 1 of the present disclosure. FIGS. 3 and 4 illustrate cross-sections of the wrap 1*b* of the orbiting scroll 1 and the wrap 2*b* of the fixed scroll 2 taken along line A-A in FIG. 1. FIG. 3(A) illustrates the orbiting scroll 1 at a rotation phase θ of 0 degrees. FIG. 3(B) illustrates the orbiting scroll 1 at a rotation phase θ of 90 degrees. FIG. 4(C) illustrates the orbiting scroll 1 at a rotation phase θ of 180 degrees. FIG. 4(D) illustrates the orbiting scroll 1 at a rotation phase θ of 270 degrees.

The rotation phase θ represents the following angle. The base circle center 200*a* of the wrap 1*b* at the start of compression illustrated in FIG. 3(A) is referred to as a base circle center 200*a*1. An angle formed by a straight line connecting the base circle center 200*a*1 to the base circle center 200*b* of the wrap 2*b* and a straight line connecting the base circle center 200*a* of the wrap 1*b* at a certain point in time to the base circle center 200*b* of the wrap 2*b* is defined as the rotation phase θ. In other words, the rotation phase θ is 0 degrees at the start of compression and changes from 0 degrees to 360 degrees. FIGS. 3(A) to 4(D) illustrate states of orbiting motion of the orbiting scroll 1 in which the wrap 1*b* is shifted by 90 degrees in a range from a rotation phase θ of 0 degrees to a rotation phase θ of 270 degrees.

When power is supplied to the glass terminal (not illustrated) located on the hermetic container 100, the rotating shaft 6 rotates together with the rotor 110*b*, thus generating a driving force. The driving force is transmitted to the orbiting bearing 1*c* via the eccentric shaft portion 6*a* and is then transmitted from the orbiting bearing 1*c* to the orbiting scroll 1, so that the orbiting scroll 1 orbits. The refrigerant gas sucked into the hermetic container 100 through the suction pipe 101 is sucked into the compression mechanism 8.

FIG. 3(A) illustrates a state in which outermost chambers are closed and suction of the refrigerant is completed. For the outermost chambers, or the compression chamber 71*a* and the compression chamber 71*b*, these compression chambers 71*a* and 71*b* decrease in volume as the chambers move inward with the orbiting motion of the orbiting scroll 1. The refrigerant gas in the compression chambers 71*a* and 71*b* is compressed as the volume of each of the compression chambers 71*a* and 71*b* decreases.

A flow of the refrigerant will now be described with reference to FIG. 1. Low-pressure refrigerant gas flows into the first space 72 in the hermetic container 100 through the suction pipe 101 and then flows into the second space 73 through the opening 7*c* and the opening 7*d* arranged in the frame 7. Upon entering the second space 73, the Low-pressure refrigerant gas is sucked into the compression chamber 71*a* and the compression chamber 71*b* as the wrap 1*b* orbits relative to the wrap 2*b* in the compression mechanism 8. The Low-pressure refrigerant gas sucked in the compression chamber 71*a* and the compression chamber 71*b* increases in pressure, or from low pressure to high pressure, because of a geometric volume change in each of the compression chambers 71*a* and 71*b* caused by movement of the wrap 1*b* relative to the wrap 2*b*. High-pressure refrigerant gas presses and opens the discharge valve 11, so that the refrigerant gas is discharged into the discharge muffler 12. The high-pressure refrigerant gas discharged in the discharge muffler 12 is discharged into the third space 74 and is then discharged out of the scroll compressor 30 through the discharge pipe 102.

During the above-described compression of the refrigerant gas, the orbiting scroll 1 experiences a load from the refrigerant gas in the compression chamber 71*a* and the compression chamber 71*b*. For this reason, the scroll compressor 30 according to Embodiment 1 includes a back-pressure chamber 300, as will be described below, to reduce the load on the orbiting scroll 1 during compression of the refrigerant gas. Furthermore, the scroll compressor 30 according to Embodiment 1 includes a first oil supply passage 310, as will be described below, to reduce or eliminate refrigerant leakage from the back-pressure chamber 300 as compared with the related art.

Figure 5:
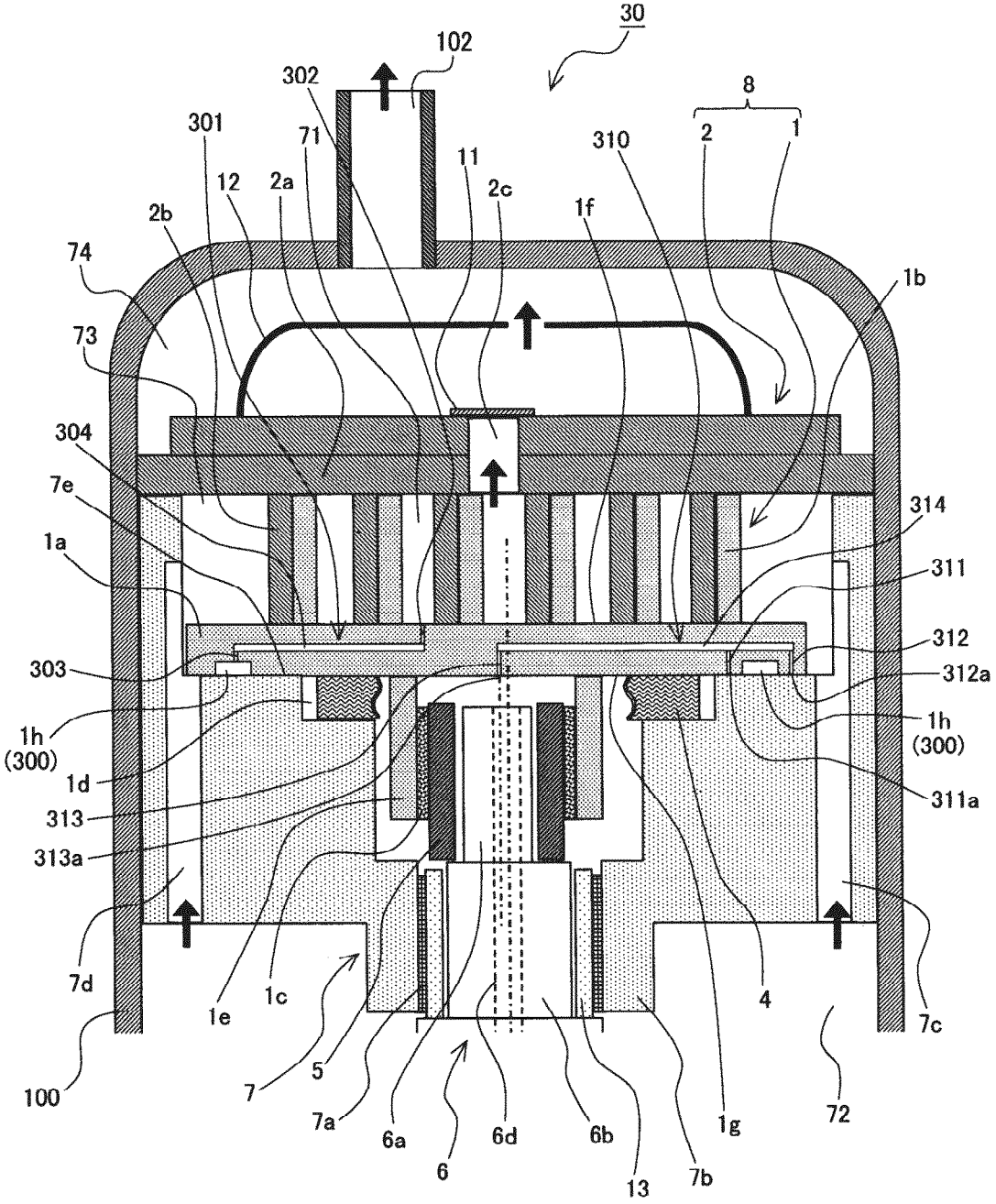
FIG. 5 is a schematic longitudinal sectional view of a part of the scroll compressor according to Embodiment 1 of the present disclosure and the part includes an orbiting scroll and its surroundings.
Figure 6:
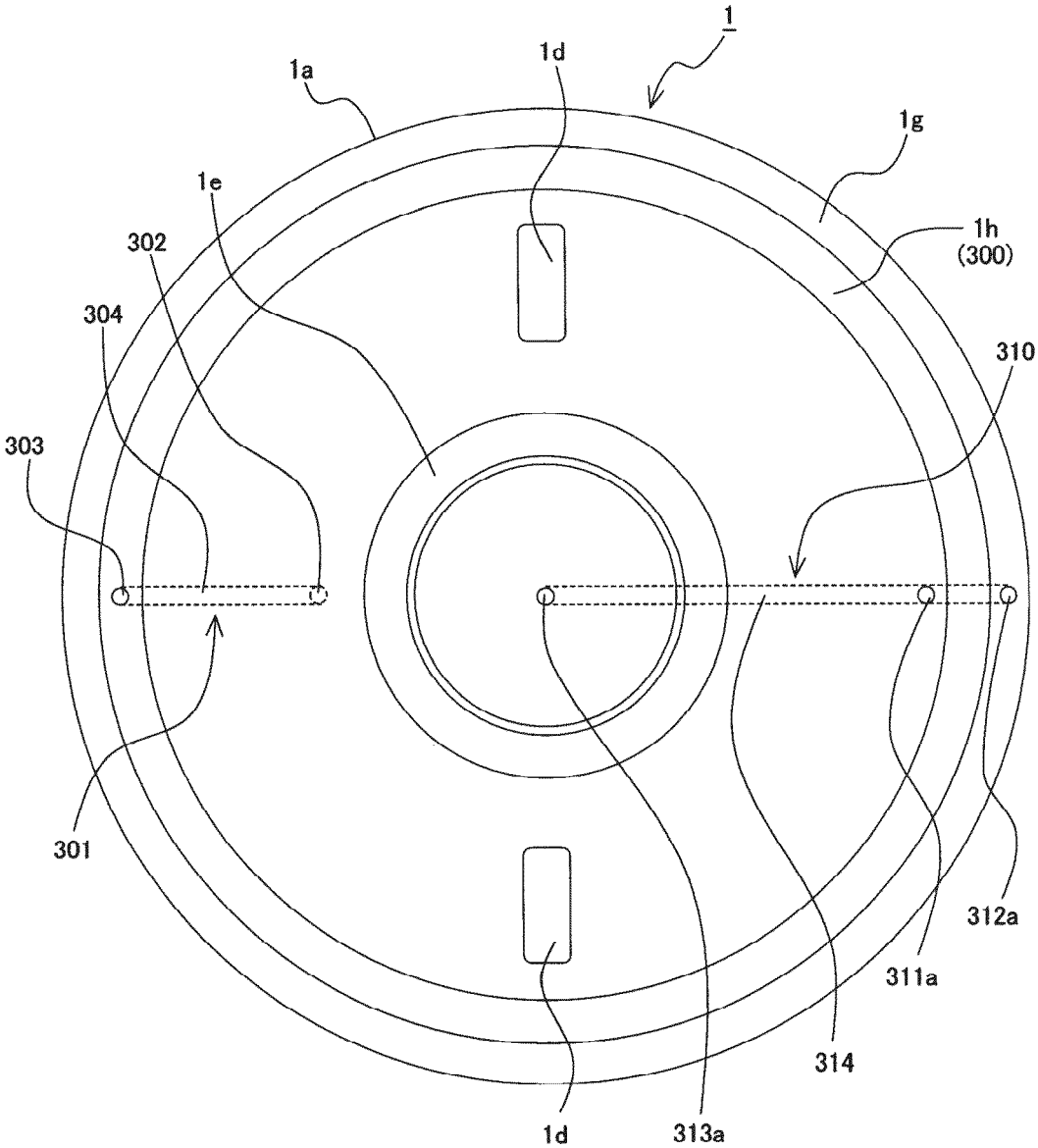
FIG. 6 is a rear view of the orbiting scroll in the scroll compressor according to Embodiment 1 of the present disclosure.

FIG. 5 is a schematic longitudinal sectional view of a part of the scroll compressor according to Embodiment 1 of the present disclosure and the part includes the orbiting scroll and its surroundings. FIG. 6 is a rear view of the orbiting scroll in the scroll compressor according to Embodiment 1 of the present disclosure.

The end plate 1*a* of the orbiting scroll 1 has an annular groove 1*h* having an opening that opens into the second surface 1*g*. The opening of the groove 1*h* is closed by the thrust face 7*e* of the frame 7, so that the groove 1*h* serves as the back-pressure chamber 300.

The end plate 1*a* of the orbiting scroll 1 has a gas communication path 301 through which the groove 1*h* communicates with the compression chamber 71 in which the refrigerant gas is being compressed. In Embodiment 1, the gas communication path 301 includes a hole 302 having an end that opens into the compression chamber 71 in which the refrigerant gas is being compressed, a hole 303 having an end that opens into the groove 1*h*, and a communication hole 304 through which the hole 302 communicates with the hole 303.

The gas communication path 301 allows the refrigerant gas in compression to be introduced into the back-pressure chamber 300. During compression of the refrigerant gas, the refrigerant gas in the compression chamber 71*a* and the compression chamber 71*b* causes a load on the orbiting scroll 1 such that the orbiting scroll 1 is pressed against the thrust face 7*e* of the frame 7. Meanwhile, the refrigerant gas in compression introduced into the back-pressure chamber 300 causes a load that acts on the orbiting scroll 1 in a direction in which the orbiting scroll 1 is moved away from the thrust face 7*e* of the frame 7. This reduces the load on the orbiting scroll 1 during compression of the refrigerant gas. Appropriately setting a position at which the gas communication path 301 communicates with the compression chamber 71, or the open position of the hole 302, and the area of the back-pressure chamber 300 on the thrust face 7*e* of the frame 7 eliminates the likelihood that the orbiting scroll 1 may be moved away from the frame 7.

The first oil supply passage 310 is located in the end plate 1*a* of the orbiting scroll 1. The first oil supply passage 310 is a passage through which the refrigerating machine oil is supplied to a gap between the second surface 1*g* of the end plate 1*a* of the orbiting scroll 1 and the thrust face 7*e* of the frame 7. The first oil supply passage 310 has a first opening that opens into at least one of a region inside the annular groove 1*h* and a region outside the annular groove 1*h* in the second surface 1*g*. The refrigerating machine oil is supplied from the first opening of the first oil supply passage 310 to the gap between the second surface 1*g* of the end plate 1*a* of the orbiting scroll 1 and the thrust face 7*e* of the frame 7.

Embodiment 1 illustrates an example of the first oil supply passage 310 having the first opening located in each of the regions inside and outside the annular groove 1*h*. Such a first oil supply passage 310 includes, for example, a hole 311, a hole 312, and a communication hole 314. The hole 311 has an opening 311*a*, which is the first opening, at a position inside the annular groove 1*h* in the second surface 1*g* of the end plate 1*a*. The hole 312 has an opening 312*a*, which is the first opening, at a position outside the annular groove 1*h* in the second surface 1*g* of the end plate 1*a*. The communication hole 314 provides communication between the hole 311 and the hole 312. In other words, in the first oil supply passage 310 in Embodiment 1, the refrigerating machine oil supplied to the communication hole 314 is supplied to the gap between the second surface 1*g* of the end plate 1*a* of the orbiting scroll 1 and the thrust face 7*e* of the frame 7 through the opening 311*a* of the hole 311 and the opening 312*a* of the hole 312.

In the scroll compressor 30 according to Embodiment 1, the refrigerating machine oil is supplied to the first oil supply passage 310 in the following manner.

As illustrated in FIGS. 1 and 5, the rotating shaft 6 has a second oil supply passage 6*d* extending axially through the rotating shaft 6. In such arrangement, when the refrigerating machine oil held in the oil sump 100*a* of the hermetic container 100 is supplied to the second oil supply passage 6*d* by the pump element 111, the refrigerating machine oil is supplied to an area between the eccentric shaft portion 6*a* of the rotating shaft 6 and the boss 1*e* of the orbiting scroll 1. The first oil supply passage 310 further has a second opening that communicates with the inside of the boss 1*e*. Specifically, the first oil supply passage 310 in Embodiment 1 includes a hole 313 having an opening 313*a*, which is the second opening, located inside the boss 1*e*. This hole 313 communicates with the communication hole 314. In such arrangement, the refrigerating machine oil in the area between the eccentric shaft portion 6*a* of the rotating shaft 6 and the boss 1*e* of the orbiting scroll 1 is supplied to the first oil supply passage 310 through the opening 313*a*. The refrigerating machine oil supplied to the first oil supply passage 310 is supplied to the gap between the second surface 1*g* of the end plate 1*a* of the orbiting scroll 1 and the thrust face 7*e* of the frame 7 through the opening 311*a* of the hole 311 and the opening 312*a* of the hole 312.

The gap between the second surface 1*g* of the end plate 1*a* and the thrust face 7*e* of the frame 7 is at a pressure that is less than or equal to that of the refrigerant gas in the back-pressure chamber 300 and that is greater than or equal to that of the refrigerant gas in the second space 73 to be sucked into the compression mechanism 8. For this reason, the oil to be supplied by the pump element 111 is at a pressure higher than the pressure in the gap between the second surface 1*g* of the end plate 1*a* and the thrust face 7*e* of the frame 7 so that the refrigerating machine oil can flow into the gap between the second surface 1*g* of the end plate 1*a* and the thrust face 7*e* of the frame 7.

As described above, both the annular groove 1*h*, serving as the back-pressure chamber 300, and the first oil supply passage 310 are arranged in the end plate 1*a* of the orbiting scroll 1. This arrangement allows the distance between the groove 1*h* and the opening 311*a* of the first oil supply passage 310 to be shorter than that in the related art, and also allows the distance between the groove 1*h* and the opening 312*a* of the first oil supply passage 310 to be shorter than that in the related art. Therefore, in the scroll compressor 30 according to Embodiment 1, while the orbiting scroll 1 revolves once, each of the opening 311*a* and the opening 312*a* of the first oil supply passage 310 can be positioned once on a route along which the groove 1*h* moves. Specifically, as described above, the orbiting scroll 1 orbits at the orbit radius, and the orbit radius is greater than or equal to the distance between the axis of the main shaft portion 6*b* and the axis of the eccentric shaft portion 6*a*. Therefore, for example, as long as a minimum distance between the opening 311*a* of the first oil supply passage 310 and the groove 1*h* is less than or equal to the distance between the axis of the main shaft portion 6*b* and the axis of the eccentric shaft portion 6*a*, the opening 311*a* of the first oil supply passage 310 can be positioned on the route of the groove 1*h*. Similarly, for example, as long as a minimum distance between the opening 312*a* of the first oil supply passage 310 and the groove 1*h* is less than or equal to the distance between the axis of the main shaft portion 6*b* and the axis of the eccentric shaft portion 6*a*, the opening 312*a* of the first oil supply passage 310 can be positioned on the route of the groove 1*h*.

In Embodiment 1, the opening 311*a* and the opening 312*a* of the first oil supply passage 310 are arranged closer to the annular groove 1*h* than in the related art. This arrangement allows an area in proximity to edges of the annular groove 1*h*, serving as the back-pressure chamber 300, to be supplied with a more sufficient amount of refrigerating machine oil than in the related art. In other words, refrigerant leakage from the back-pressure chamber 300 can be reduced or eliminated as compared with the related art. The scroll compressor 30 according to Embodiment 1 will now be compared with a scroll compressor according to Comparative Example, and the reason why the above-described advantages of the scroll compressor 30 according to Embodiment 1 are obtained will be described below.

For description of the scroll compressor according to Comparative Example, components of the scroll compressor according to Comparative Example are designated by reference signs obtained by adding "1000" to the reference signs of the corresponding components in Embodiment 1. For example, an orbiting scroll of the scroll compressor according to Comparative Example is an orbiting scroll 1001, a back-pressure chamber in the scroll compressor according to Comparative Example is a back-pressure chamber 1300, and a groove that serves as the back-pressure chamber 1300 in the scroll compressor according to Comparative Example is a groove 1001*h*.

Figure 7:
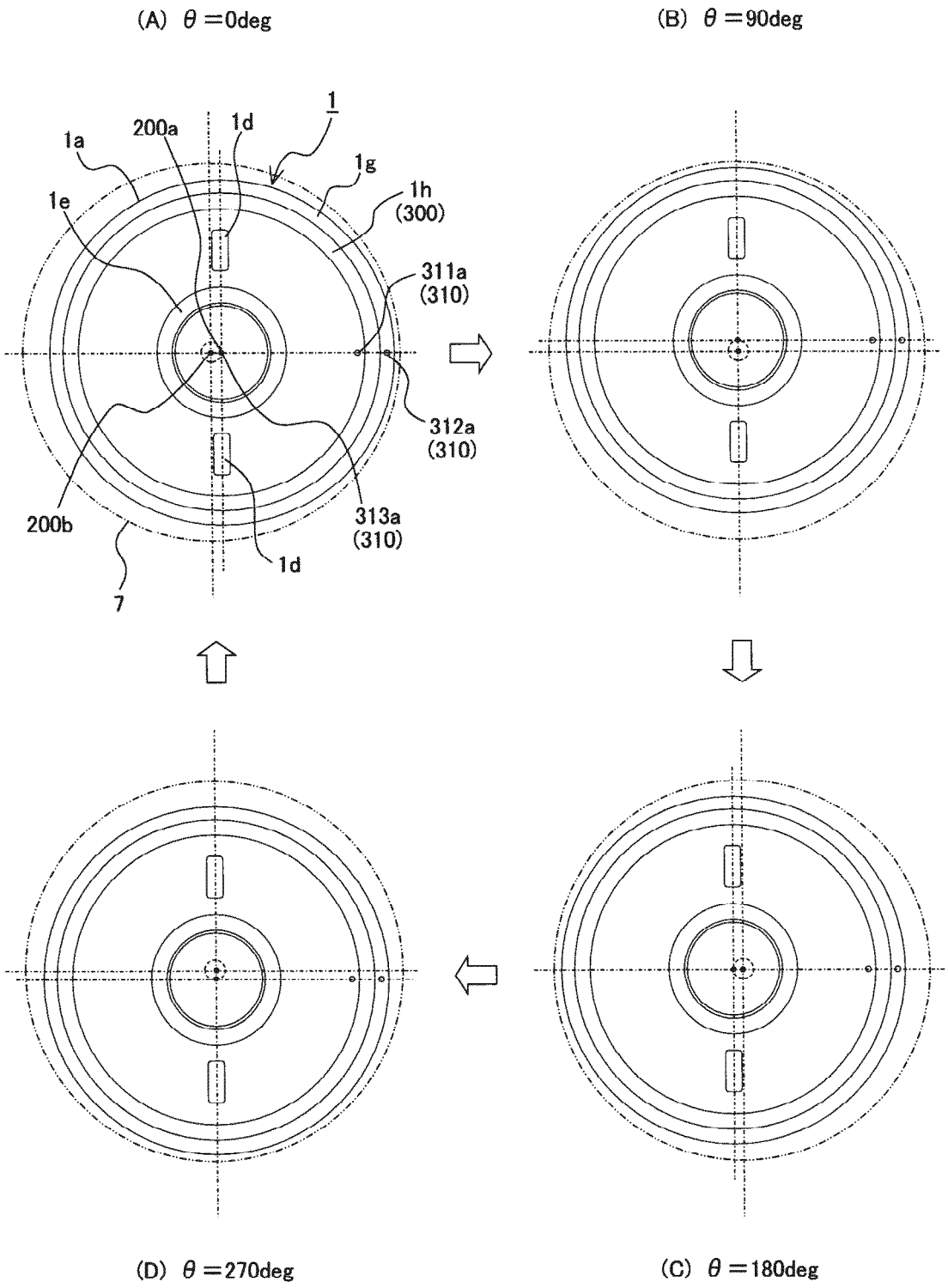
FIG. 7 includes diagrams illustrating the positional relationship between a back-pressure chamber and openings of a first oil supply passage in the scroll compressor according to Embodiment 1 of the present disclosure.

FIG. 7 illustrates the positional relationship between the back-pressure chamber and the openings of the first oil supply passage in the scroll compressor according to Embodiment 1 of the present disclosure. FIG. 7 includes rear views of the orbiting scroll 1. In FIG. 7, a part of the frame 7 is represented by an alternate long and two short dashes line, which is an imaginary line. FIG. 7(A) illustrates the orbiting scroll 1 at a rotation phase θ of 0 degrees. FIG. 7(B) illustrates the orbiting scroll 1 at a rotation phase θ of 90 degrees. FIG. 7(C) illustrates the orbiting scroll 1 at a rotation phase θ of 180 degrees. FIG. 7(D) illustrates the orbiting scroll 1 at a rotation phase θ of 270 degrees. In FIG. 7, depiction of the gas communication path 301 is omitted.

Figure 8:
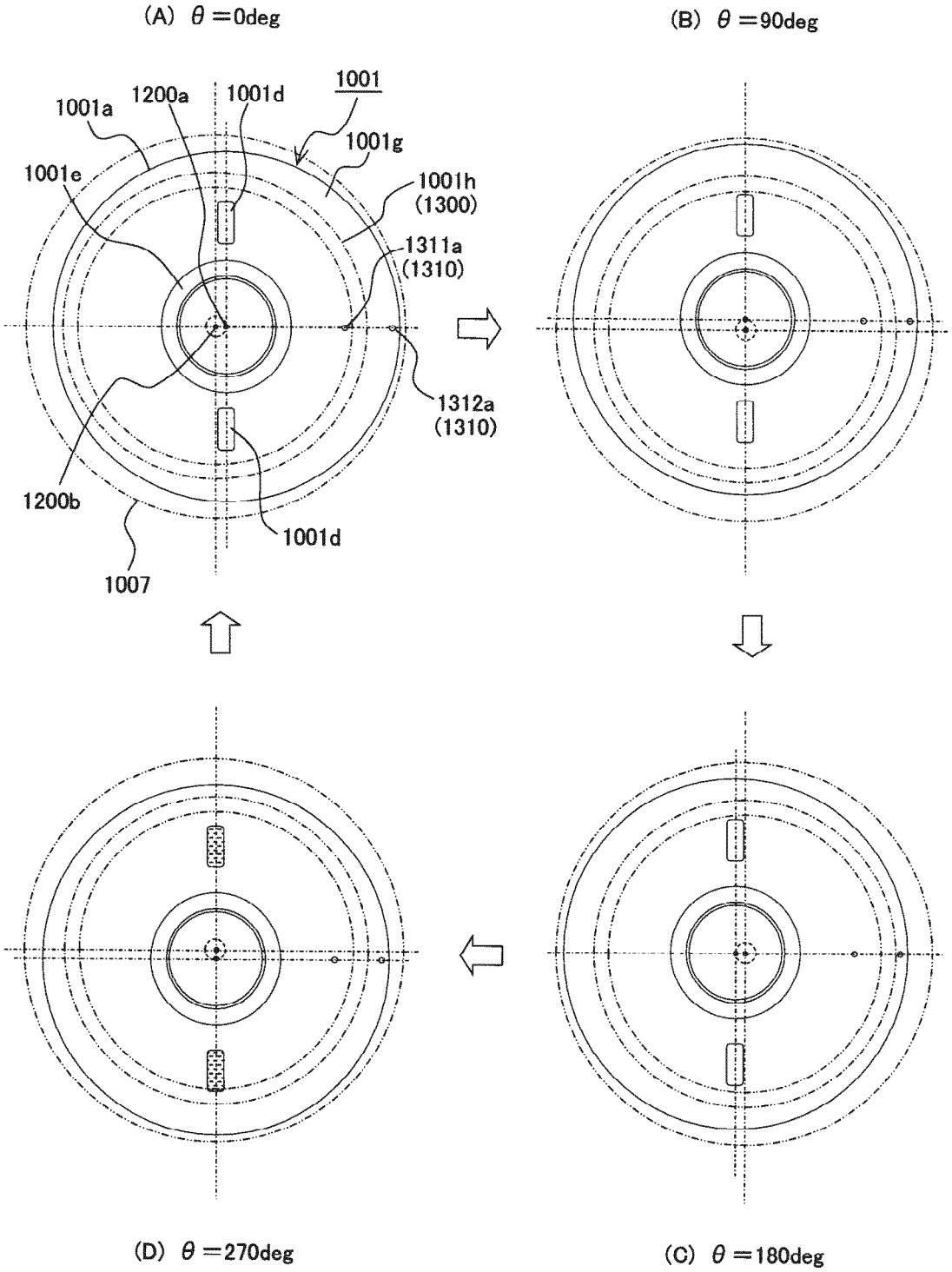
FIG. 8 includes diagrams illustrating the positional relationship between a back-pressure chamber and openings of a first oil supply passage in a scroll compressor according to Comparative Example.

FIG. 8 illustrates the positional relationship between the back-pressure chamber and openings of a first oil supply passage in the scroll compressor according to Comparative Example. FIG. 8 includes rear views of the orbiting scroll 1001 in Comparative Example. In FIG. 8, a part of a frame 1007 in Comparative Example is represented by an alternate long and two short dashes line, which is an imaginary line. FIG. 8(A) illustrates the orbiting scroll 1001 at a rotation phase θ of 0 degrees. FIG. 8(B) illustrates the orbiting scroll 1001 at a rotation phase θ of 90 degrees. FIG. 8(C) illustrates the orbiting scroll 1001 at a rotation phase θ of 180 degrees. FIG. 8(D) illustrates the orbiting scroll 1001 at a rotation phase θ of 270 degrees. The back-pressure chamber 1300 in FIG. 8 is located at the same position as that of the back-pressure chamber in the scroll compressor disclosed in Patent Literature 1. In the scroll compressor disclosed in Patent Literature 1, the end plate of the orbiting scroll has the oil supply passage through which the refrigerating machine oil is supplied to the gap between the end plate of the orbiting scroll and the frame. The oil supply passage has the openings arranged in the surface of the end plate facing the frame, and the refrigerating machine oil is supplied through these openings to the gap between the end plate of the orbiting scroll and the frame. In FIG. 8, an opening 1311*a* and an opening 1312*a* of a first oil supply passage 1310 are located at the same positions as those of the openings of the oil supply passage in the scroll compressor disclosed in Patent Literature 1.

As illustrated in FIG. 8, in the scroll compressor according to Comparative Example, the annular groove 1001*h*, serving as the back-pressure chamber 1300, is located in the frame 1007. Additionally, in the scroll compressor according to Comparative Example, the first oil supply passage 1310 is located in an end plate 1001*a* of the orbiting scroll 1001. Specifically, while the orbiting scroll 1001 is orbiting during the refrigerant gas compression operation, the positions of the opening 1311*a* and 1312*a* of the first oil supply passage 1310 are changed relative to the annular groove 1001*h*, serving as the back-pressure chamber 1300.

To supply the refrigerating machine oil to the gap between the end plate 1001*a* of the orbiting scroll 1001 and the frame 1007, the opening 1311*a* and the opening 1312*a* of the first oil supply passage 1310 need to be arranged so as not to communicate with the annular groove 1001*h*, serving as the back-pressure chamber 1300. For this reason, in the scroll compressor according to Comparative Example, the opening 1311*a* and the opening 1312*a* of the first oil supply passage 1310 need to be positioned at a distance greater than or equal to an orbit radius of the orbiting scroll 1001 from the annular groove 1001*h*, serving as the back-pressure chamber 1300.

Consequently, in the scroll compressor according to Comparative Example, the refrigerating machine oil fails to be sufficiently supplied to an area in proximity to edges of the annular groove 1001*h*, serving as the back-pressure chamber 1300, so that refrigerant leakage from the back-pressure chamber 1300 fails to be sufficiently reduced or eliminated. This may lead to unstable behavior of the orbiting scroll 1001, resulting in lower reliability of the scroll compressor according to Comparative Example. In addition, this may lead to an increase in sliding loss between the end plate 1001*a* of the orbiting scroll 1001 and the frame 1007, resulting in lower performance of the scroll compressor according to Comparative Example.

In contrast, in the scroll compressor 30 according to Embodiment 1, both the annular groove 1*h*, serving as the back-pressure chamber 300, and the first oil supply passage 310 are located in the end plate 1*a* of the orbiting scroll 1. Accordingly, while the orbiting scroll 1 is orbiting in the scroll compressor 30 according to Embodiment 1, the positions of the openings 311*a* and 312*a* of the first oil supply passage 310 are not changed relative to the annular groove 1*h*, serving as the back-pressure chamber 300. For this reason, although the openings 311*a* and 312*a* of the first oil supply passage 310 are located closer to the annular groove 1*h* than in the related art, the first oil supply passage 310 does not communicate with the groove 1001*h*, serving as the back-pressure chamber 1300, in the scroll compressor 30 according to Embodiment 1.

Therefore, as illustrated in FIG. 7, in the scroll compressor 30 according to Embodiment 1, the opening 311*a* and the opening 312*a* of the first oil supply passage 310 can be positioned on the route of the annular groove 1*h*, serving as the back-pressure chamber 300. For example, the position of the opening 311*a* of the first oil supply passage 310 in the orbiting scroll 1 at a rotation phase θ of 0 degrees in FIG. 7(A) coincides with the position of the groove 1*h* in the orbiting scroll 1 at a rotation phase θ of 180 degrees in FIG. 7(C). In addition, for example, the position of the opening 312*a* of the first oil supply passage 310 in the orbiting scroll 1 at a rotation phase θ of 180 degrees in FIG. 7(C) coincides with the position of the groove 1*h* in the orbiting scroll 1 at a rotation phase θ of 0 degrees in FIG. 7(A).

Therefore, in the scroll compressor 30 according to Embodiment 1, the refrigerating machine oil can be sufficiently supplied to the area in proximity to the edges of the annular groove 1*h*, serving as the back-pressure chamber 300, so that refrigerant leakage from the back-pressure chamber 300 can be reduced or eliminated as compared with the related art. As a result, the orbiting scroll 1 in the scroll compressor 30 according to Embodiment 1 is less likely to exhibit unstable behavior than in the related art, so that the reliability of the scroll compressor is less likely to decrease than in the related art. Furthermore, in the scroll compressor 30 according to Embodiment 1, sliding loss between the end plate 1*a* of the orbiting scroll 1 and the frame 7 is less likely to increase than in the related art, so that the performance is less likely to decrease than in the related art. In other words, the above-described arrangement of the back-pressure chamber 300 and the first oil supply passage 310 in Embodiment 1 allows the scroll compressor 30 to exhibit high reliability and high efficiency.

As described above, the scroll compressor 30 according to Embodiment 1 incudes the fixed scroll 2, the orbiting scroll 1, the frame 7, and the hermetic container 100. The fixed scroll 2 includes the end plate 2*a* and the wrap 2*b* located on the end plate 2*a*. The orbiting scroll 1 includes the end plate 1*a* and the wrap 1*b* located on the first surface 1*f*, which faces the fixed scroll 2, of the end plate 1*a*. The orbiting scroll 1 orbits relative to the fixed scroll 2 such that a compression chamber 71 to compress the refrigerant is defined between the wrap 2*b* and the wrap 1*b*. The frame 7 faces the second surface 1*g* opposite the first surface 1*f* in the orbiting scroll 1, and supports the load on the orbiting scroll 1 during compression of refrigerant gas. The hermetic container 100 contains the fixed scroll 2, the orbiting scroll 1, and the frame 7, and incudes the oil sump 100*a* in which the refrigerating machine oil is held. The scroll compressor 30 according to Embodiment 1 is a scroll compressor in which refrigerant gas taken in the hermetic container 100 is compressed in the compression chamber 71.

Furthermore, in the scroll compressor 30 according to Embodiment 1. the end plate 1*a* of the orbiting scroll 1 has the annular groove 1*h*, the gas communication path 301, and the first oil supply passage 310. The annular groove 1*h* has the opening that opens into the second surface 1*g*, and serves as the back-pressure chamber 300 with the opening being closed by the frame 7. The gas communication path 301 allows the annular groove 1*h* to communicate with the compression chamber 71 in which the refrigerant gas is being compressed. The first oil supply passage 310 has a first opening that opens into at least one of the regions inside and outside the annular groove 1*h* in the second surface 1*g* and through which the refrigerating machine oil is supplied to the gap between the second surface 1*g* and the frame 7.

In the scroll compressor 30 according to Embodiment 1, both the annular groove 1*h*, serving as the back-pressure chamber 300, and the first oil supply passage 310 are located in the end plate 1*a* of the orbiting scroll 1. Accordingly, in the scroll compressor 30 according to Embodiment 1, the distance between the annular groove 1*h*, serving as the back-pressure chamber 300, and the first opening of the first oil supply passage 310 is constant at all times. Such a configuration of the scroll compressor 30 according to Embodiment 1 enables the first opening of the first oil supply passage 310 to be closer to the annular groove 1*h*, serving as the back-pressure chamber 300, than in the related art. Therefore, in the scroll compressor 30 according to Embodiment 1, the area in proximity to the edges of the annular groove 1*h*, serving as the back-pressure chamber 300, can be supplied with a more sufficient amount of refrigerating machine oil than in the related art, so that refrigerant leakage from the back-pressure chamber 300 can be reduced or eliminated as compared with the related art.

Embodiment 2

The scroll compressor 30 in Embodiment 1 can further include a third oil supply passage 315, which will be described later, to further reduce sliding loss in the compression mechanism 8. In Embodiment 2, items that are not particularly mentioned are the same as those in Embodiment 1, and the same functions and components as those in Embodiment 1 are designated by the same reference signs in the following description.

Figure 9:
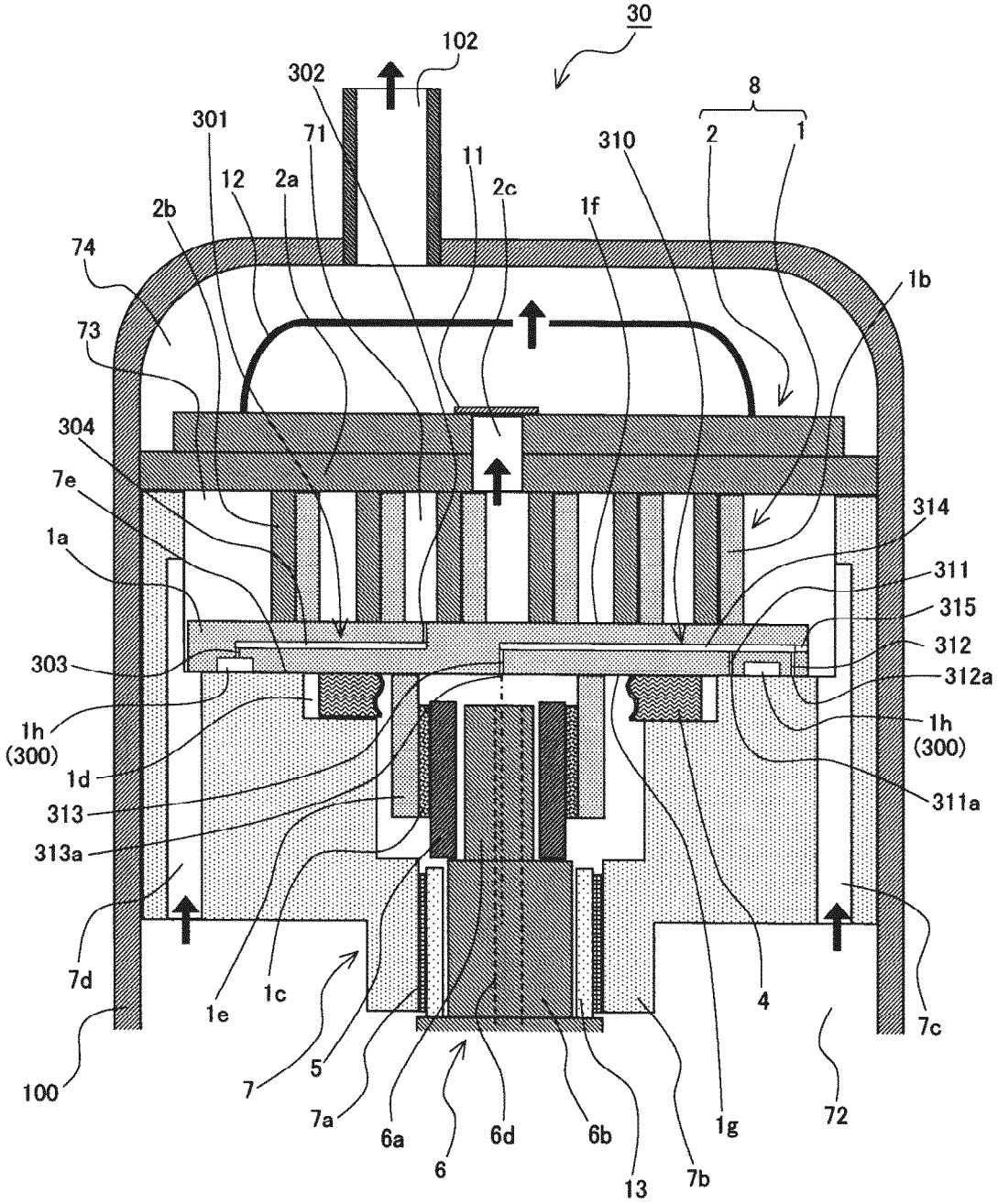
FIG. 9 is a schematic longitudinal sectional view of a part of a scroll compressor according to Embodiment 2 of the present disclosure and the part includes an orbiting scroll and its surroundings.
Figure 10:
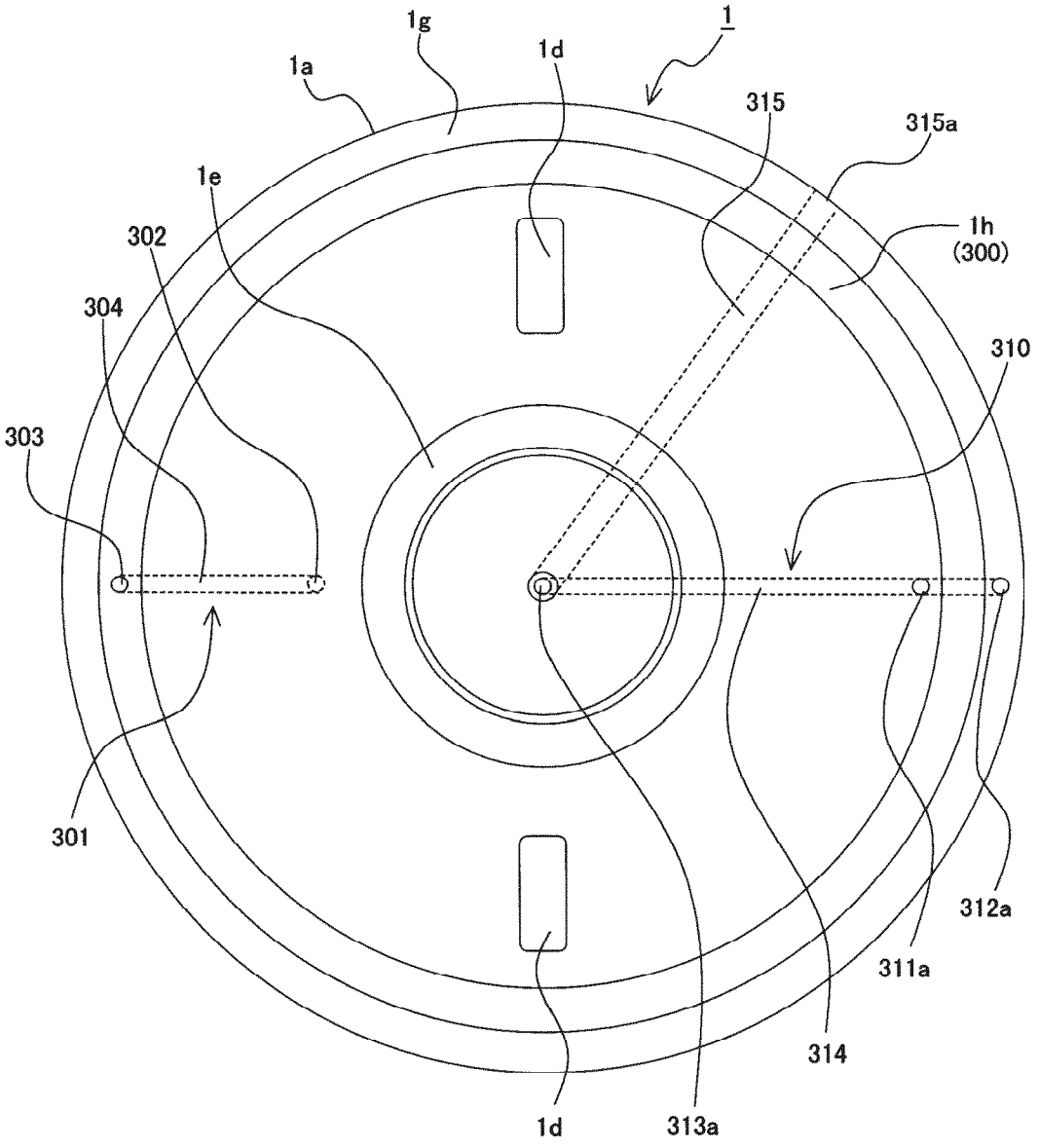
FIG. 10 is a rear view of the orbiting scroll in the scroll compressor according to Embodiment 2 of the present disclosure.

FIG. 9 is a schematic longitudinal sectional view of a part of a scroll compressor according to Embodiment 2 of the present disclosure and the part includes an orbiting scroll and its surroundings. FIG. 10 is a rear view of the orbiting scroll in the scroll compressor according to Embodiment 2 of the present disclosure.

The end plate 1*a* of the orbiting scroll 1 of the scroll compressor 30 according to Embodiment 2 has the third oil supply passage 315 in addition to the first oil supply passage 310 described in Embodiment 1. The third oil supply passage 315 has an opening 315*a* that opens into an outer circumferential face of the end plate 1*a*. In other words, the third oil supply passage 315 has one end that opens into the outer circumferential face of the end plate 1*a*. The third oil supply passage 315 is a passage through which the refrigerating machine oil supplied to the third oil supply passage 315 is supplied to the outer circumferential face of the end plate 1*a* through the opening 315*a*.

In Embodiment 2, the other or opposite end of the third oil supply passage 315 from the opening 315*a* communicates with the hole 313 of the first oil supply passage 310. In other words, the refrigerating machine oil in the area between the eccentric shaft portion 6*a* of the rotating shaft 6 and the boss 1*e* of the orbiting scroll 1 is supplied to the third oil supply passage 315.

Since the scroll compressor 30 according to Embodiment 2 has the same configuration as that of the scroll compressor 30 according to Embodiment 1, the scroll compressor 30 according to Embodiment 2 offers the same advantages as those of the scroll compressor 30 according to Embodiment 1. Furthermore, since the scroll compressor 30 according to Embodiment 2 has the third oil supply passage 315 in the end plate 1*a* of the orbiting scroll 1, the following advantages are obtained.

The third oil supply passage 315 in the scroll compressor 30 according to Embodiment 2 allows the refrigerating machine oil to be supplied from the outer circumferential face of the end plate 1*a* of the orbiting scroll 1 to the gap between the second surface 1*g* of the end plate 1*a* of the orbiting scroll 1 and the thrust face 7*e* of the frame 7. As a result, in the scroll compressor 30 according to Embodiment 2, the gap between the second surface 1*g* of the end plate 1*a* of the orbiting scroll 1 and the thrust face 7*e* of the frame 7 can be supplied with a larger amount of refrigerating machine oil than in the scroll compressor 30 according to Embodiment 1. Therefore, the scroll compressor 30 according to Embodiment 2 can achieve a more reduction in sliding loss in the compression mechanism 8 than the scroll compressor 30 according to Embodiment 1. Such a configuration of the scroll compressor 30 according to Embodiment 2 allows the scroll compressor 30 to exhibit higher reliability and higher efficiency than the scroll compressor 30 according to Embodiment 1 exhibits.

The amount of refrigerating machine oil to be supplied to the outer circumferential face of the end plate 1*a* through the third oil supply passage 315 can be adjusted by using a flow resistance in the third oil supply passage 315. For example, the outer circumferential face of the end plate 1*a* can be supplied with a more amount of refrigerating machine oil by making the flow resistance in the third oil supply passage 315 smaller than that in the first oil supply passage 310.

Embodiment 3

The end plate 1*a* of the orbiting scroll 1 in the scroll compressor 30 according to Embodiment 1 or Embodiment 2 may have a recess 320, which will be described in Embodiment 3. Such a configuration allows the scroll compressor 30 to exhibit higher reliability and also allows the scroll compressor 30 to exhibit higher efficiency. In Embodiment 3, items that are not particularly mentioned are the same as those in Embodiment 1 or Embodiment 2, and the same functions and components as those in Embodiment 1 or Embodiment 2 are designated by the same reference signs in the following description. An example in which the scroll compressor 30 according to Embodiment 1 has a recess 320 will be described below.

Figure 11:
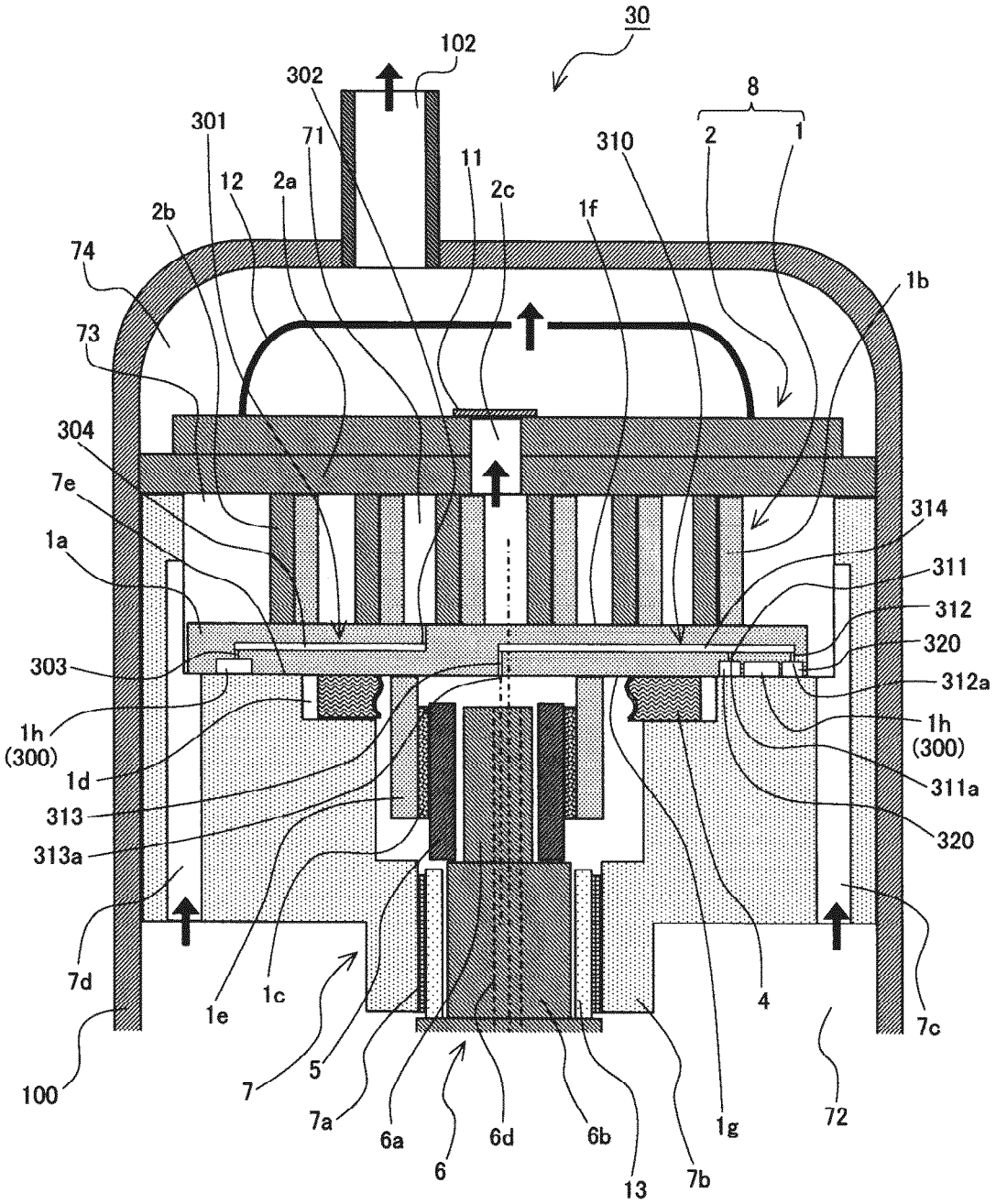
FIG. 11 is a schematic longitudinal sectional view of a part of a scroll compressor according to Embodiment 3 of the present disclosure and the part includes an orbiting scroll and its surroundings.
Figure 12:
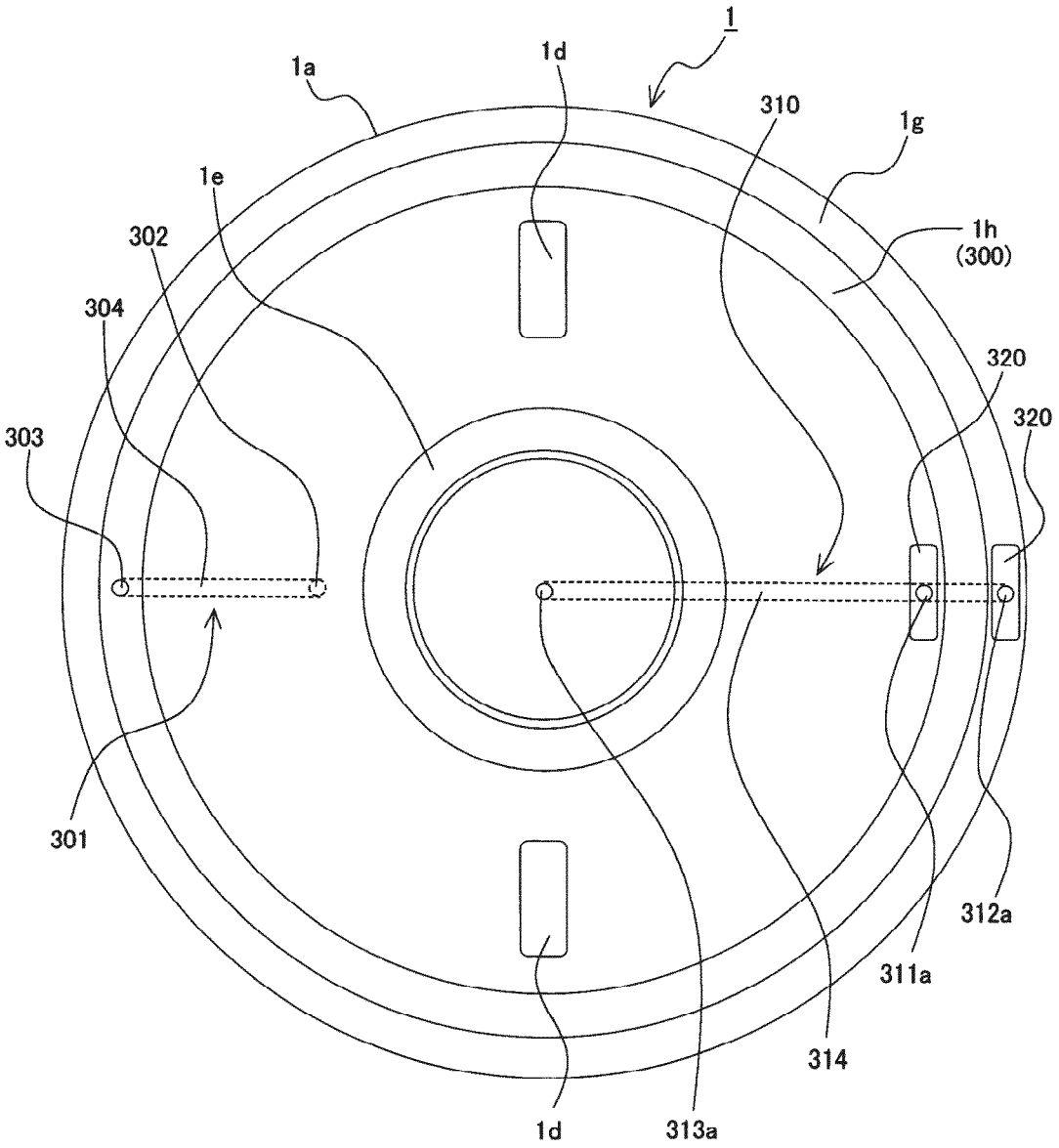
FIG. 12 is a rear view of the orbiting scroll in the scroll compressor according to Embodiment 3 of the present disclosure.

FIG. 11 is a schematic longitudinal sectional view of a part of a scroll compressor according to Embodiment 3 of the present disclosure and the part includes an orbiting scroll and its surroundings. FIG. 12 is a rear view of the orbiting scroll in the scroll compressor according to Embodiment 3 of the present disclosure.

In the scroll compressor 30 according to Embodiment 3, the second surface 1*g* of the end plate 1*a* of the orbiting scroll 1 has a recess 320. The first oil supply passage 310 has a first opening that opens into the recess 320. The first oil supply passage 310 in Embodiment 3 has the opening 311*a* and the opening 312*a* as first openings. Accordingly, the scroll compressor 30 according to Embodiment 3 has a recess 320 into which the opening 311*a* opens and a recess 320 into which the opening 312*a* opens.

Since the recesses 320 are arranged, the refrigerating machine oil from the first oil supply passage 310 is temporarily held in the recesses 320. Then, the refrigerating machine oil held in the recesses 320 is supplied to the gap between the second surface 1*g* of the end plate 1*a* of the orbiting scroll 1 and the thrust face 7*e* of the frame 7.

Since the scroll compressor 30 according to Embodiment 3 has the same configuration as that of the scroll compressor 30 according to Embodiment 1 or Embodiment 2, the scroll compressor 30 according to Embodiment 3 offers the same advantages as those of the scroll compressor 30 according to Embodiment 1 or Embodiment 2. Furthermore, since the scroll compressor 30 according to Embodiment 3 has the recesses 320 in the second surface 1*g* of the end plate 1*a* of the orbiting scroll 1, the following advantages are also obtained.

Since the recesses 320 are arranged, the refrigerating machine oil temporarily held in the recesses 320 is supplied to the gap between the second surface 1*g* of the end plate 1*a* of the orbiting scroll 1 and the thrust face 7*e* of the frame 7. This allows the refrigerating machine oil to be more uniformly supplied to the gap between the second surface 1*g* of the end plate 1*a* of the orbiting scroll 1 and the thrust face 7*e* of the frame 7 than in the scroll compressor 30 according to Embodiment 1 or Embodiment 2. Therefore, in the scroll compressor 30 according to Embodiment 3, the orbiting scroll 1 is less likely to exhibit unstable behavior than in the scroll compressor 30 according to Embodiment 1 or Embodiment 2, leading to a further reduction in sliding loss in the compression mechanism 8. This allows the scroll compressor 30 according to Embodiment 3 to exhibit higher reliability than the scroll compressor 30 according to Embodiment 1 or Embodiment 2 exhibits, resulting in higher efficiency of the scroll compressor 30 according to Embodiment 3.

Embodiment 4

The recesses 320 in Embodiment 3 may have the following shape, as will be described in Embodiment 4, to achieve higher reliability of the scroll compressor 30, leading to higher efficiency of the scroll compressor 30. In Embodiment 4, items that are not particularly mentioned are the same as those in Embodiment 3, and the same functions and components as those in Embodiment 3 are designated by the same reference signs in the following description.

Figure 13:
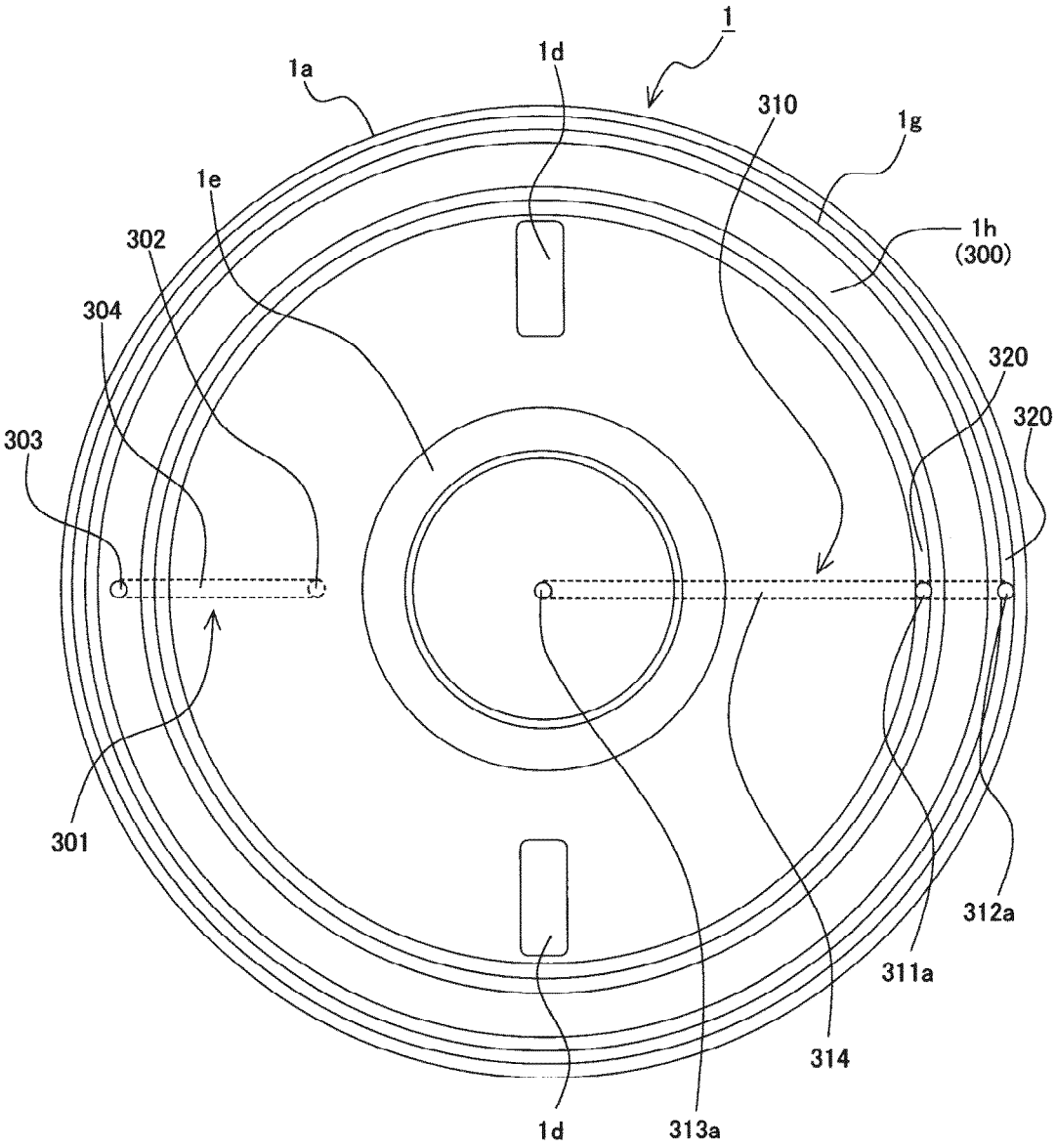
FIG. 13 is a rear view of an orbiting scroll in a scroll compressor according to Embodiment 4 of the present disclosure.

FIG. 13 is a rear view of an orbiting scroll in a scroll compressor according to Embodiment 4 of the present disclosure.

The recesses 320 in Embodiment 4 are annular grooves. Such a shape of the recesses 320 in the scroll compressor 30 according to Embodiment 4 allows the refrigerating machine oil to be more uniformly supplied to the gap between the second surface 1*g* of the end plate 1*a* of the orbiting scroll 1 and the thrust face 7*e* of the frame 7 than in the scroll compressor 30 according to Embodiment 3. Therefore, in the scroll compressor 30 according to Embodiment 4, the orbiting scroll 1 is less likely to exhibit unstable behavior than in the scroll compressor 30 according to Embodiment 3, leading to a further reduction in sliding loss in the compression mechanism 8. This allows the scroll compressor 30 according to Embodiment 4 to exhibit higher reliability than the scroll compressor 30 according to Embodiment 3 exhibits, resulting in higher efficiency of the scroll compressor 30 according to Embodiment 4.

Embodiment 5

The key grooves 1*d* in the scroll compressor 30 according to Embodiment 3 or Embodiment 4 may be arranged in the following manner, as will be described in Embodiment 5. The key grooves 1*d* arranged in the following manner can reduce sliding loss between the Oldham ring 4 and the orbiting scroll 1, leading to higher efficiency of the scroll compressor 30. In Embodiment 5, items that are not particularly mentioned are the same as those in Embodiment 3 or Embodiment 4, and the same functions and components as those in Embodiment 3 or Embodiment 4 are designated by the same reference signs in the following description. An example in which arrangement of the key grooves 1*d* in the scroll compressor 30 according to Embodiment 4 is changed will be described below.

Figure 14:
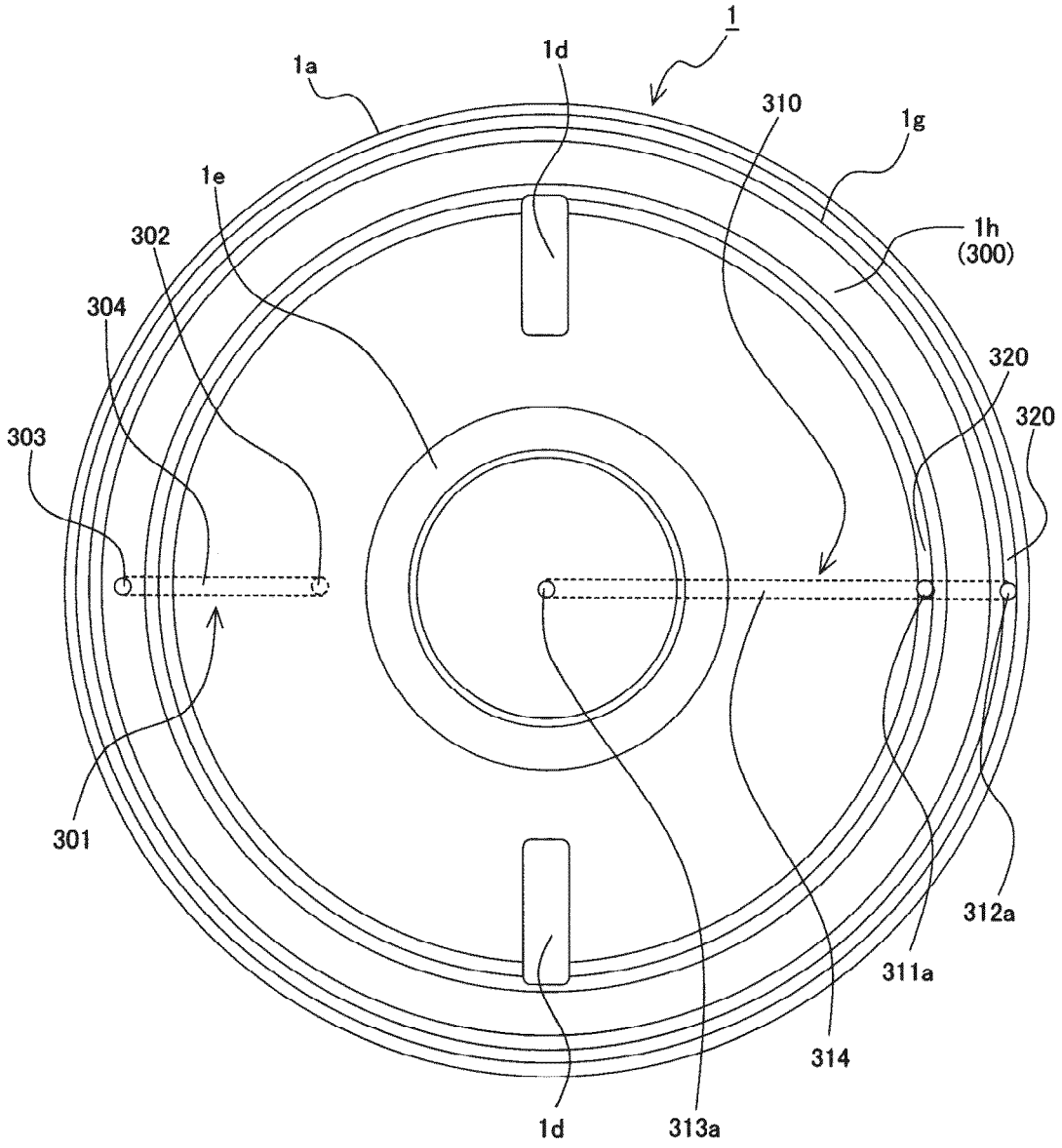
FIG. 14 is a rear view of an orbiting scroll in a scroll compressor according to Embodiment 5 of the present disclosure.

FIG. 14 is a rear view of an orbiting scroll in a scroll compressor according to Embodiment 5 of the present disclosure.

In the scroll compressor 30 according to Embodiment 5, each key groove 1*d* communicates one of the recesses 320. Accordingly, the refrigerating machine oil supplied to the recess 320 from the first oil supply passage 310 is supplied to the key grooves 1*d* in addition to the gap between the second surface 1*g* of the end plate 1*a* of the orbiting scroll 1 and the thrust face 7*e* of the frame 7.

Since the scroll compressor 30 according to Embodiment 5 has the same configuration as that of the scroll compressor 30 according to Embodiment 3 or Embodiment 4, the scroll compressor 30 according to Embodiment 5 offers the same advantages as those of the scroll compressor 30 according to Embodiment 3 or Embodiment 4. Furthermore, since the refrigerating machine oil in the recess 320 is supplied to the key grooves 1*d* in the scroll compressor 30 according to Embodiment 5, sliding loss between the Oldham ring 4 and the orbiting scroll 1 can be reduced. This allows the scroll compressor 30 according to Embodiment 5 to exhibit higher efficiency than the scroll compressor 30 according to Embodiment 3 or Embodiment 4 exhibits.

REFERENCE SIGNS LIST

1 orbiting scroll 1*a* end plate 1*b* wrap 1*c* orbiting bearing 1*d* key groove 1*e* boss 1*f* first surface 1*g* second surface 1*h* groove 2 fixed scroll 2*a* end plate 2*b* wrap 2*c* discharge port 4 Oldham ring 4*a* ring portion 4*b* key 5 slider 6 rotating shaft 6*a* eccentric shaft portion 6*b* main shaft portion 6*c* sub-shaft portion 6*d* second oil supply passage 7 frame 7*a* main bearing 7*b* boss 7*c* opening 7*d* opening 7*e* thrust face 8 compression mechanism 9 sub-frame 9*a* sub-frame holder 10 sub-bearing 11 discharge valve 12 discharge muffler 13 sleeve 30 scroll compressor 60 first balance weight 61 second balance weight 71 compression chamber 71*a* compression chamber 71*b* compression chamber first space 73 second space 74 third space 100 hermetic container 100*a* oil sump 101 suction pipe 102 discharge pipe 110 motor 110*a* stator 110*b* rotor 111 pump element 200*a* base circle center 200*a*1 base circle center 200*b* base circle center 201*a* inward-facing surface 201*b* inward-facing surface 202*a* outward-facing surface 202*b* outward-facing surface 300 back-pressure chamber 301 gas communication path 302 hole 303 hole 304 communication hole 310 first oil supply passage 311 hole 311*a* opening 312 hole 312*a* opening 313 hole 313*a* opening 314 communication hole 315 third oil supply passage 315*a* opening 320 recess

The invention claimed is:

1. A scroll compressor comprising:

a fixed scroll including a first end plate and a first wrap located on the first end plate;

an orbiting scroll including a second end plate and a second wrap located on a first surface of the second end plate that faces the fixed scroll, the orbiting scroll being disposed to define a compression chamber to compress refrigerant between the first wrap and the second wrap and orbiting relative to the fixed scroll;

a frame facing a second surface opposite the first surface in the orbiting scroll and supporting a load on the orbiting scroll during compression of refrigerant gas; and a hermetic container containing the fixed scroll, the orbiting scroll, and the frame and including an oil sump in which refrigerating machine oil is held, the scroll compressor being configured to suck the refrigerant gas into the hermetic container and then compress the refrigerant gas in the compression chamber, the second end plate having an annular groove having an opening that opens into the second surface and serving as a back-pressure chamber with the opening being closed by the frame, a gas communication path through which the groove communicates with the compression chamber in which the refrigerant gas is being compressed, and a first oil supply passage having a first opening that opens into at least one of a region inside the groove and a region outside the groove in the second surface and through which the refrigerating machine oil is supplied to a gap between the second surface and the frame, the scroll compressor further comprising a motor contained in the hermetic container; and a rotating shaft contained in the hermetic container, the rotating shaft including a main shaft portion connected to the motor and an eccentric shaft portion having an axis eccentric with respect to an axis of the main shaft portion, wherein the orbiting scroll includes a boss located on the second surface of the second end plate and the boss supports the eccentric shaft portion such that the eccentric shaft portion is rotatable, and wherein a minimum distance between the first opening and the groove is less than or equal to a distance between the axis of the main shaft portion and the axis of the eccentric shaft portion.

2. The scroll compressor of claim 1, wherein the rotating shaft has a second oil supply passage through which the refrigerating machine oil held in the oil sump is supplied to an area between the eccentric shaft portion and the boss, wherein the first oil supply passage has a second opening that opens at a position at which the second opening communicates with an inside of the boss, and wherein the refrigerating machine oil supplied to the area between the eccentric shaft portion and the boss is supplied to the gap between the second surface and the frame through the first oil supply passage.

3. The scroll compressor of claim 1, wherein the second end plate has a third oil supply passage that opens into an outer circumferential face of the second end plate and through which the refrigerating machine oil is supplied to the outer circumferential face of the second end plate.

4. The scroll compressor of claim 1, wherein the second surface of the second end plate has a recess, and wherein the first opening of the first oil supply passage opens into the recess.

5. The scroll compressor of claim 4, further comprising:

an Oldham ring disposed between the second end plate of the orbiting scroll and the frame and restricting rotation of the orbiting scroll, wherein the Oldham ring has a plurality of keys, wherein the second end plate of the orbiting scroll has a plurality of key grooves in which the plurality of keys are slidably fitted, and wherein the plurality of key grooves communicate with the recess.

* * * * *